US010504405B2

(12) United States Patent
Bae et al.

(10) Patent No.: US 10,504,405 B2
(45) Date of Patent: Dec. 10, 2019

(54) DISPLAY DEVICE INCLUDING REFERENCE VOLTAGE SUPPLY

(71) Applicant: LG Display Co., Ltd., Seoul (KR)

(72) Inventors: Hanjin Bae, Seoul (KR); Sangho Yu, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/676,662

(22) Filed: Aug. 14, 2017

(65) Prior Publication Data

US 2018/0053462 A1 Feb. 22, 2018

(30) Foreign Application Priority Data

Aug. 17, 2016 (KR) ..... 10-2016-0104456

(51) Int. Cl.
*G09G 3/20* (2006.01)
*G09G 3/3233* (2016.01)

(52) U.S. Cl.
CPC ..... *G09G 3/2074* (2013.01); *G09G 3/3233* (2013.01); *G09G 2300/043* (2013.01); *G09G 2300/0426* (2013.01); *G09G 2300/0819* (2013.01); *G09G 2310/0251* (2013.01); *G09G 2310/08* (2013.01); *G09G 2320/0223* (2013.01); *G09G 2320/0233* (2013.01); *G09G 2320/045* (2013.01)

(58) Field of Classification Search
CPC ..... G09G 3/2074; G09G 3/3233; G09G 2320/0223; G09G 2310/0251; G09G 2300/0426; G09G 2320/045; G09G 2310/08; G09G 2300/0819; G09G 2300/043; G09G 2320/0233
See application file for complete search history.

(56) References Cited

U.S. PATENT DOCUMENTS

2004/0095168 A1 5/2004 Miyazawa
2007/0013573 A1* 1/2007 Hashimoto ..... G09G 3/3614 341/172
2011/0128268 A1 6/2011 Kim et al.
2012/0313920 A1* 12/2012 Shimoshikiryoh .. G09G 3/3648 345/211

(Continued)

FOREIGN PATENT DOCUMENTS

CN 103 927 977 A 7/2014
KR 10-1577907 B1 12/2015

(Continued)

OTHER PUBLICATIONS

European Search Report, dated Jan. 23, 2018 for the European patent application No. 17186524.9.

*Primary Examiner* — Premal R Patel
(74) *Attorney, Agent, or Firm* — Polsinelli PC

(57) ABSTRACT

A display device is disclosed. The display device includes a display panel including data lines, panel lines, scan lines, and pixels, a power circuit configured to output a reference voltage for initializing subpixels of the pixels, a plurality of branch lines configured to divide a path of the reference voltage into a plurality of paths, and a switch circuit configured to switch a path between the branch lines and the panel lines in response to a switch control signal. The switch circuit changes the path between the branch lines and the panel lines at intervals of predetermined time.

20 Claims, 38 Drawing Sheets

(56) References Cited

U.S. PATENT DOCUMENTS

| | | | | |
|---|---|---|---|---|
| 2013/0208015 | A1 | 8/2013 | Kim et al. | |
| 2014/0022289 | A1 | 1/2014 | Lee et al. | |
| 2014/0339508 | A1 | 11/2014 | Hong | |
| 2015/0035734 | A1* | 2/2015 | Lee | G09G 3/3258 345/76 |
| 2015/0123953 | A1 | 5/2015 | Shim et al. | |
| 2015/0138179 | A1 | 5/2015 | Park | |
| 2015/0154908 | A1 | 6/2015 | Nam et al. | |
| 2015/0170574 | A1* | 6/2015 | Kim | G09G 3/3233 345/76 |
| 2015/0187268 | A1 | 7/2015 | Tani et al. | |
| 2015/0372070 | A1* | 12/2015 | Yoon | H01L 27/3276 257/40 |
| 2015/0379937 | A1 | 12/2015 | Kim et al. | |
| 2016/0012798 | A1 | 1/2016 | Oh et al. | |
| 2016/0071445 | A1 | 3/2016 | Kim et al. | |
| 2016/0078806 | A1 | 3/2016 | Lim et al. | |
| 2017/0004764 | A1 | 1/2017 | Kim et al. | |

FOREIGN PATENT DOCUMENTS

| | | | |
|---|---|---|---|
| KR | 10-1581593 | B1 | 12/2015 |
| KR | 10-2016-0068995 | A | 6/2016 |
| KR | 10-2017-0010223 | A | 1/2017 |
| KR | 10-2017-0021406 | A | 2/2017 |
| KR | 10-2017-0023292 | A | 3/2017 |
| KR | 10-2017-0049667 | A | 5/2017 |
| KR | 10-2017-0064038 | A | 6/2017 |
| KR | 10-2017-0076952 | A | 7/2017 |
| KR | 10-2017-0078979 | A | 7/2017 |

* cited by examiner

| | | | | | | | | | |
|---|---|---|---|---|---|---|---|---|---|
| 1 | 2 | 1 | 2 | 1 | 2 | 1 | 2 | 1 | 2 |
| 2 | 1 | 2 | 1 | 2 | 1 | 2 | 1 | 2 | 1 |
| 1 | 2 | 1 | 2 | 1 | 2 | 1 | 2 | 1 | 2 |
| 2 | 1 | 2 | 1 | 2 | 1 | 2 | 1 | 2 | 1 |
| 1 | 2 | 1 | 2 | 1 | 2 | 1 | 2 | 1 | 2 |
| 2 | 1 | 2 | 1 | 2 | 1 | 2 | 1 | 2 | 1 |
| 1 | 2 | 1 | 2 | 1 | 2 | 1 | 2 | 1 | 2 |
| 2 | 1 | 2 | 1 | 2 | 1 | 2 | 1 | 2 | 1 |

| | | | | | | | | | |
|---|---|---|---|---|---|---|---|---|---|
| 1 | 2 | 1 | 2 | 1 | 2 | 1 | 2 | 1 | 2 |
| 1 | 2 | 1 | 2 | 1 | 2 | 1 | 2 | 1 | 2 |
| 2 | 1 | 2 | 1 | 2 | 1 | 2 | 1 | 2 | 1 |
| 2 | 1 | 2 | 1 | 2 | 1 | 2 | 1 | 2 | 1 |
| 1 | 2 | 1 | 2 | 1 | 2 | 1 | 2 | 1 | 2 |
| 1 | 2 | 1 | 2 | 1 | 2 | 1 | 2 | 1 | 2 |
| 2 | 1 | 2 | 1 | 2 | 1 | 2 | 1 | 2 | 1 |
| 2 | 1 | 2 | 1 | 2 | 1 | 2 | 1 | 2 | 1 |

| | | | | | | | | | |
|---|---|---|---|---|---|---|---|---|---|
| 1 | 1 | 2 | 2 | 1 | 1 | 2 | 2 | 1 | 1 |
| 2 | 2 | 1 | 1 | 2 | 2 | 1 | 1 | 2 | 2 |
| 1 | 1 | 2 | 2 | 1 | 1 | 2 | 2 | 1 | 1 |
| 2 | 2 | 1 | 1 | 2 | 2 | 1 | 1 | 2 | 2 |
| 1 | 1 | 2 | 2 | 1 | 1 | 2 | 2 | 1 | 1 |
| 2 | 2 | 1 | 1 | 2 | 2 | 1 | 1 | 2 | 2 |
| 1 | 1 | 2 | 2 | 1 | 1 | 2 | 2 | 1 | 1 |
| 2 | 2 | 1 | 1 | 2 | 2 | 1 | 1 | 2 | 2 |

| | | | | | | | | | |
|---|---|---|---|---|---|---|---|---|---|
| 1 | 1 | 1 | 1 | 1 | 1 | 1 | 1 | 1 | 1 |
| 2 | 2 | 2 | 2 | 2 | 2 | 2 | 2 | 2 | 2 |
| 1 | 1 | 1 | 1 | 1 | 1 | 1 | 1 | 1 | 1 |
| 2 | 2 | 2 | 2 | 2 | 2 | 2 | 2 | 2 | 2 |
| 1 | 1 | 1 | 1 | 1 | 1 | 1 | 1 | 1 | 1 |
| 2 | 2 | 2 | 2 | 2 | 2 | 2 | 2 | 2 | 2 |
| 1 | 1 | 1 | 1 | 1 | 1 | 1 | 1 | 1 | 1 |
| 2 | 2 | 2 | 2 | 2 | 2 | 2 | 2 | 2 | 2 |

| | | | | | | | | | |
|---|---|---|---|---|---|---|---|---|---|
| 1 | 2 | 1 | 2 | 1 | 2 | 1 | 2 | 1 | 2 |
| 1 | 2 | 1 | 2 | 1 | 2 | 1 | 2 | 1 | 2 |
| 1 | 2 | 1 | 2 | 1 | 2 | 1 | 2 | 1 | 2 |
| 1 | 2 | 1 | 2 | 1 | 2 | 1 | 2 | 1 | 2 |
| 1 | 2 | 1 | 2 | 1 | 2 | 1 | 2 | 1 | 2 |
| 1 | 2 | 1 | 2 | 1 | 2 | 1 | 2 | 1 | 2 |
| 1 | 2 | 1 | 2 | 1 | 2 | 1 | 2 | 1 | 2 |
| 1 | 2 | 1 | 2 | 1 | 2 | 1 | 2 | 1 | 2 |

FIG. 14

Fodd

| | | | | | | | | | |
|---|---|---|---|---|---|---|---|---|---|
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |

time

Feven

| | | | | | | | | | |
|---|---|---|---|---|---|---|---|---|---|
| 2 | 2 | 2 | 2 | 2 | 2 | 2 | 2 | 2 | 2 |
| 2 | 2 | 2 | 2 | 2 | 2 | 2 | 2 | 2 | 2 |
| 2 | 2 | 2 | 2 | 2 | 2 | 2 | 2 | 2 | 2 |
| 2 | 2 | 2 | 2 | 2 | 2 | 2 | 2 | 2 | 2 |
| 2 | 2 | 2 | 2 | 2 | 2 | 2 | 2 | 2 | 2 |
| 2 | 2 | 2 | 2 | 2 | 2 | 2 | 2 | 2 | 2 |
| 2 | 2 | 2 | 2 | 2 | 2 | 2 | 2 | 2 | 2 |
| 2 | 2 | 2 | 2 | 2 | 2 | 2 | 2 | 2 | 2 |

Y

X

DISPLAY DEVICE INCLUDING REFERENCE VOLTAGE SUPPLY

CROSS-REFERENCE TO RELATED APPLICATION

This application claims the benefit of Korean Patent Application No. 10-2016-0104456 filed on Aug. 17, 2016, the entire contents of which is incorporated herein by reference in its entirety for all purposes as if fully set forth herein.

BACKGROUND

Field of the Disclosure

The present disclosure relates to a display device and more particularly, to a display device capable of providing uniform luminance to the entire screen even if a level of a reference voltage applied to pixels is non-uniform.

Description of the Background

An active matrix organic light emitting diode (OLED) display includes a plurality of OLEDs capable of emitting light by themselves and has many advantages, such as fast response time, high emission efficiency, high luminance, wide viewing angle, and the like. The OLED includes an anode, a cathode, and an organic compound layer between the anode and the cathode. The organic compound layer includes a hole injection layer HIL, a hole transport layer HTL, an emission layer EML, an electron transport layer ETL, and an electron injection layer EIL. When a driving voltage is applied to the anode and the cathode, holes passing through the hole transport layer HTL and electrons passing through the electron transport layer ETL move to the emission layer EML and form excitons. As a result, the emission layer EML generates visible light.

Each pixel of the OLED display includes a driving element for controlling a current flowing in the OLED. The driving element may be implemented as a transistor. It is preferable that the driving elements of all the pixels are designed to have the same electrical characteristics including a threshold voltage, mobility, etc. However, the electrical characteristics of the driving elements are not uniform due to process conditions, a driving environment, and the like. As a driving time of the driving element increases, a stress of the driving element increases. There is a difference in an amount of stress between the driving elements depending on the supplied data voltage. The electrical characteristics of the driving element are affected by the stress. Thus, the electrical characteristics of the driving element vary as the driving time passed.

A method of compensating for change in driving characteristics of the pixels in the OLED display is classified into an internal compensation method and an external compensation method.

In the internal compensation method, a variation in a threshold voltage between the driving elements is automatically compensated inside a pixel circuit. Because the internal compensation method has to determine the current flowing in the OLED regardless of the threshold voltage of the driving element, configuration of the pixel circuit can be complicated. Moreover, the internal compensation method is difficult to compensate for a variation in mobility between the driving elements.

The external compensation method senses the electrical characteristics (including the threshold voltage, the mobility, etc.) of the driving elements and modulates pixel data of an input image based on the sensing result by a compensation circuit outside a display panel, thereby compensating for change in driving characteristics of each pixel.

More specifically, the external compensation method senses a voltage or a current of the pixel through sensing signal lines connected to the pixels of the display panel, converts the sensing result into digital data using an analog-to-digital converter (ADC), and transmits the digital data to a timing controller. The timing controller modulates digital video data of the input image based on the result of sensing the pixel and compensates for change in the driving characteristics of each pixel.

The pixels of the display panel may include a plurality of subpixels having different colors for color representation. A predetermined reference voltage may be applied to all the subpixels of the display panel. The reference voltage may be set to a voltage for initializing all the subpixels. After the subpixels are initialized to the reference voltage, the data voltage of the input image may be applied to the subpixels.

The reference voltage of the same magnitude (or the same level) has to be applied to all the subpixels. However, a load variation between lines supplied with the reference voltage may be generated depending on a distance between a power circuit generating the reference voltage and the subpixels. The load variation may be generated by a difference between a resistance (R) and a capacitance (C) connected to the line. The level of the reference voltage may vary depending on a position of the subpixels due to the load variation between the lines supplied with the reference voltage. When the level of the reference voltage varies as described above, the initialization of the pixels can be non-uniform. Therefore, a difference in luminance and color between pixels of the same gray level may be caused by the position of the subpixels of the display panel.

A buffer (or an amplifier) may be connected to the line supplied with the reference voltage. However, because an offset variation exists between the buffers, the level of the reference voltage may vary depending on the position of the subpixels.

As the size of the display panel increases, the load variation of the line supplied with the reference voltage increases. In order to reduce the load variation of the line, the line may be divided inside the display panel, and the reference voltage may be individually applied to the divided lines. In this instance, blocks of different luminances may be seen on the screen around a division position of the line.

SUMMARY

The present disclosure provides a display device and a method of driving the same capable of providing uniform luminance to the entire screen even if a level of a reference voltage applied to pixels is non-uniform.

In one aspect of the present disclosure, there is provided a display device including a display panel including data lines, panel lines, scan lines, and pixels; a power circuit configured to output a reference voltage for initializing subpixels of the pixels; a plurality of branch lines configured to divide a path of the reference voltage into a plurality of paths; and a switch circuit configured to switch a path between the branch lines and the panel lines. The switch circuit changes the path between the branch lines and the panel lines at intervals of predetermined time.

In another aspect of the present disclosure, there is provided a display device including a display panel including data lines, panel lines, scan lines, and pixels; a first power circuit configured to supply a first reference voltage to subpixels of the pixels through a first line; a second power circuit configured to supply a second reference voltage to the subpixels of the pixels through a second line; a plurality of first branch lines configured to divide a first path of the first reference voltage into a plurality of paths; a plurality of second branch lines configured to divide a second path of the second reference voltage into a plurality of paths; a first switch circuit configured to switch a path between the plurality of first branch lines and the panel lines; and a second switch circuit configured to switch a path between the plurality of second branch lines and the panel lines. Each of the first and second switch circuits changes the path between the branch line and the panel lines at intervals of predetermined time.

It is to be understood that both the foregoing general and description and the following detailed description are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this specification, illustrate aspects of the disclosure and together with the description serve to explain the principles of the disclosure.

In the drawings:

FIGS. 11A to 11C and FIGS. 12 to 14 illustrate a subpixel supplied with a first reference voltage and a subpixel supplied with a second first reference voltage;

DETAILED DESCRIPTION

Figure 1:
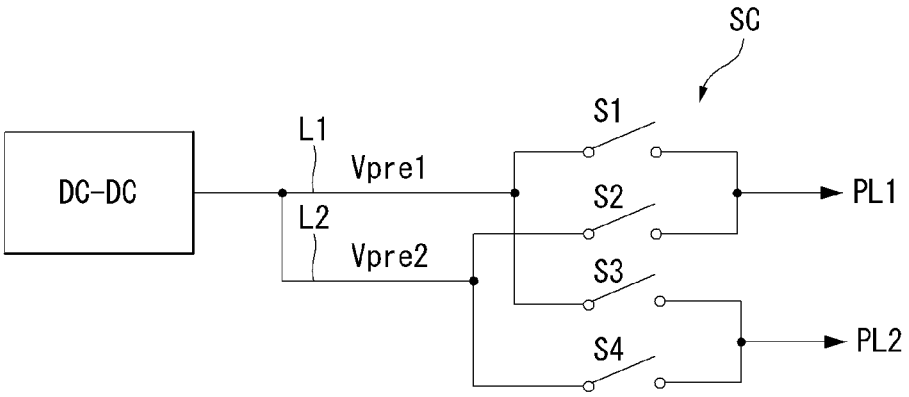
FIGS. 1 to 3 illustrate first and second reference voltages according to an aspect of the disclosure.

Reference will now be made in detail to aspects of the present disclosure, examples of which are illustrated in the accompanying drawings. However, the present disclosure is not limited to aspects disclosed below, and may be implemented in various forms. These aspects are provided so that the present disclosure will be described more completely, and will fully convey the scope of the present disclosure to those skilled in the art to which the present disclosure pertains. Particular features of the present disclosure can be defined by the scope of the claims.

Shapes, sizes, ratios, angles, number, and the like illustrated in the drawings for describing aspects of the present disclosure are merely exemplary, and the present disclosure is not limited thereto unless specified as such. Like reference numerals designate like elements throughout. In the following description, when a detailed description of certain functions or configurations related to this document that may unnecessarily cloud the gist of the disclosure have been omitted.

In the present disclosure, when the terms "include", "have", "comprised of", etc. are used, other components may be added unless "~only" is used. A singular expression can include a plural expression as long as it does not have an apparently different meaning in context.

In the explanation of components, even if there is no separate description, it is interpreted as including margins of error or an error range.

In the description of positional relationships, when a structure is described as being positioned "on or above", "under or below", "next to" another structure, this description should be construed as including a case in which the structures directly contact each other as well as a case in which a third structure is disposed therebetween.

The terms "first", "second", etc. may be used to describe various components, but the components are not limited by such terms. The terms are used only for the purpose of distinguishing one component from other components. For example, a first component may be designated as a second component, and vice versa, without departing from the scope of the present disclosure.

The features of various aspects of the present disclosure can be partially combined or entirely combined with each other, and can be technically interlocking-driven in various ways. The aspects can be independently implemented, or can be implemented in conjunction with each other.

Reference will now be made in detail to aspects of the disclosure, examples of which are illustrated in the accompanying drawings. Wherever possible, the same reference numbers will be used throughout the drawings to refer to the same or like parts. Detailed descriptions of known arts will be omitted if such may mislead the aspects of the disclosure.

In the following description, a display device according to aspects is described focusing on an organic light emitting diode (OLED) display, by way of example. However, aspects are not limited.

Figure 2:
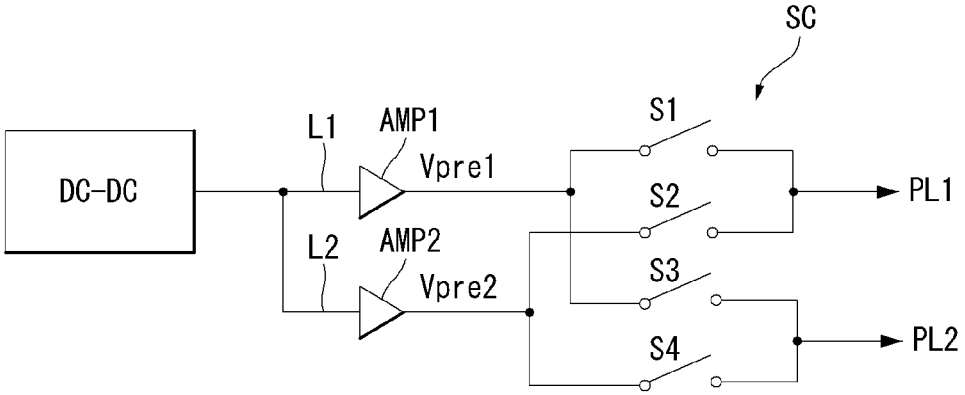
Figure 3:
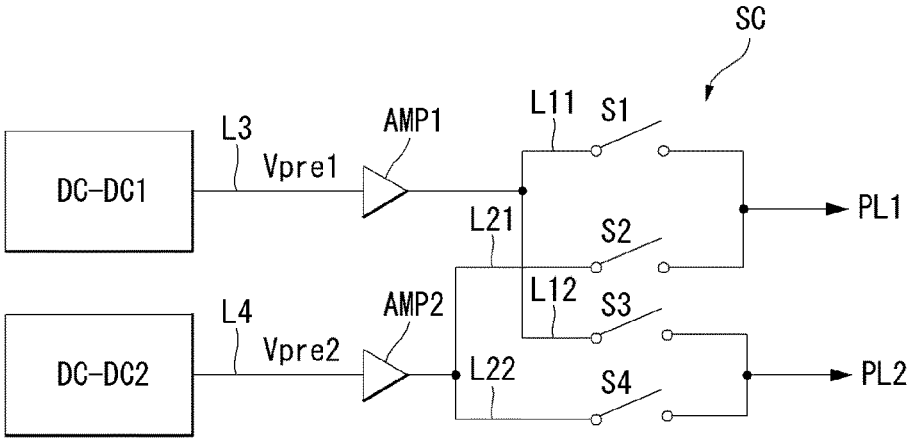

Referring to FIGS. 1 to 3, a power circuit DC-DC outputs a reference voltage Vpre using a DC-to-DC converter that receives a DC input voltage and outputs a DC voltage. The power circuit DC-DC may be integrated into a power management integrated circuit (PMIC) of a display device. The power circuit DC-DC outputs various DC voltages (for example, voltages EVDD, EVSS, VGH, VGL, a gamma reference voltage, etc.) required to drive the display device, in addition to the reference voltage Vpre. The reference voltage Vpre is a DC voltage for initializing pixels. The reference voltage Vpre may have different voltage levels in a driving mode for reproducing an input image on the screen and a sensing mode for sensing driving characteristics of the pixels.

Figure 4A:
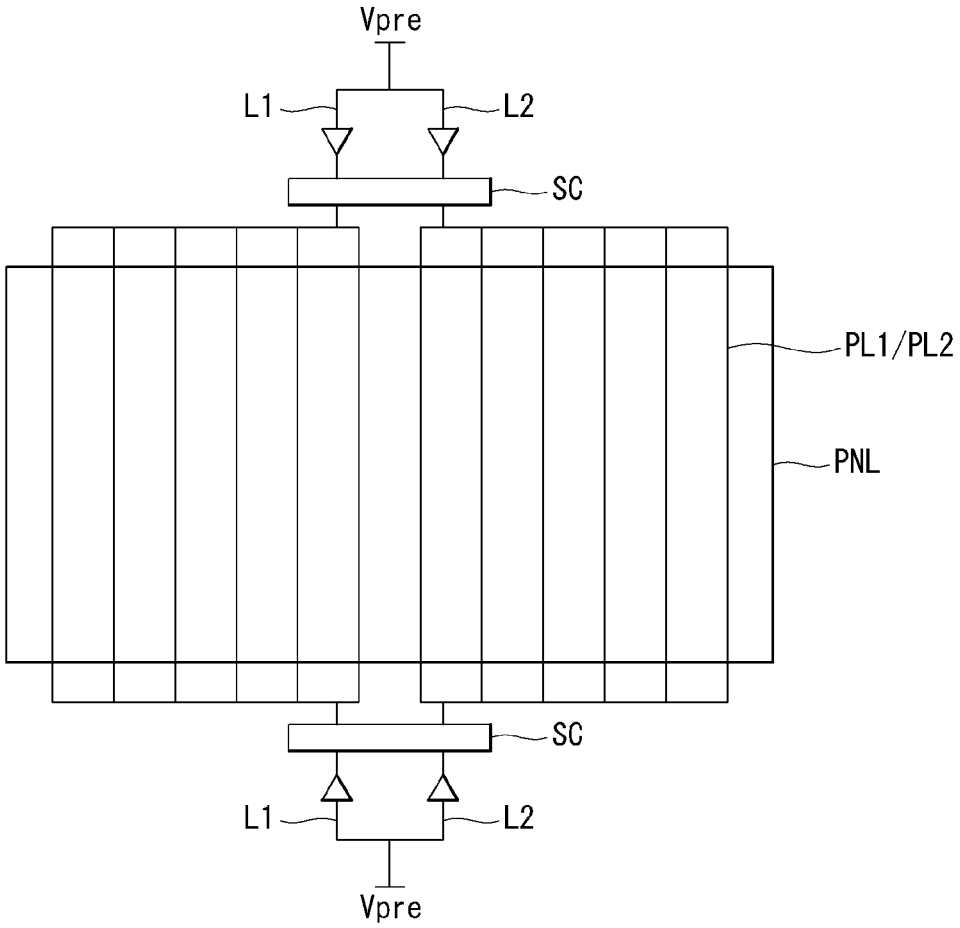
FIGS. 4A and 4B illustrate panel lines supplied with a reference voltage according to an aspect of the disclosure.
Figure 4B:
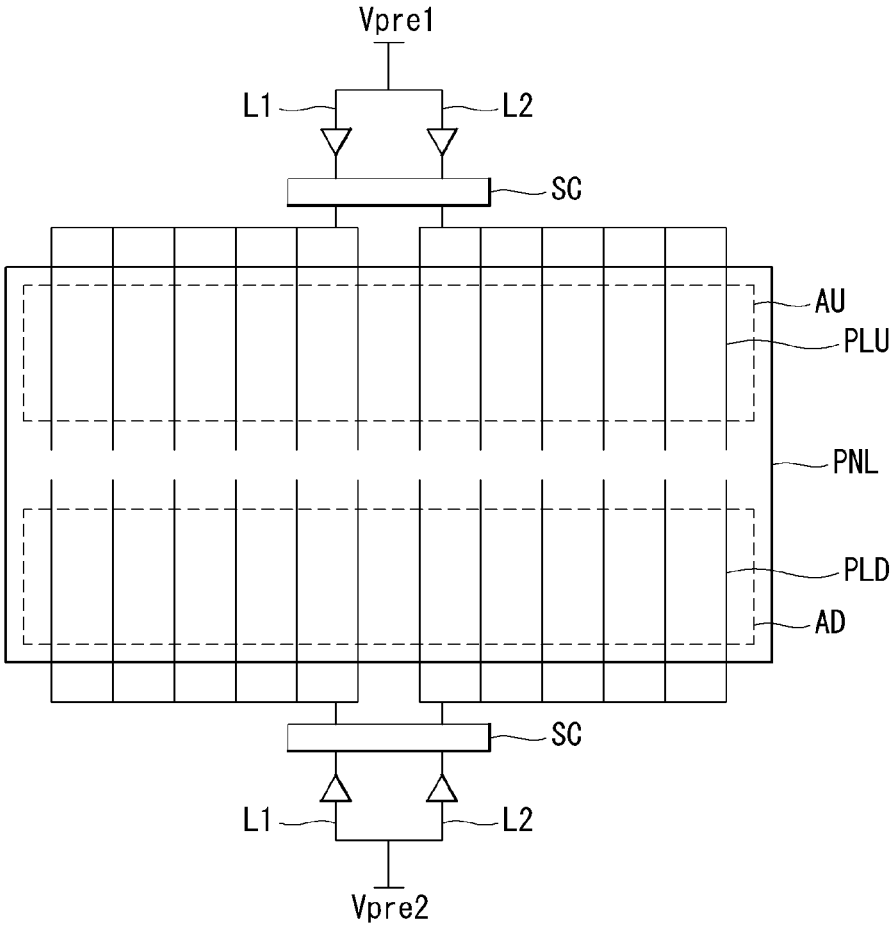

As shown in FIGS. 1 and 2, the reference voltage Vpre output by the power circuit DC-DC is divided into various paths through branch lines L1 and L2 and distributed to a plurality of panel lines PL1 and PL2. FIGS. 1 and 3 illustrate that the reference voltage Vpre is divided into two paths through the branch lines L1 and L2, by way of example. However, aspects of the present disclosure are not limited thereto, as shown in FIGS. 4A and 4B.

In an example of FIG. 1, the branch lines L1 and L2 include a first branch line L1 and a second branch line L2 connected to a single output terminal of the power circuit DC-DC.

As the screen size of the display device increases, lengths of the branch lines L1 and L2 increase as well. The lengths of the first and second branch lines L1 and L2 may vary depending on a position of a pixel of a display panel. Because a difference between the lengths of the first and second branch lines L1 and L2 increases as the screen size of the display device increases, a difference in voltage drop and RC load between the branch lines L1 and L2 increases. As a branch point of the reference voltage Vpre is far away from the power circuit DC-DC, a level difference between first and second reference voltages Vpre1 and Vpre2, which are separated into different paths via the branch lines L1 and L2, may increase due to a difference between the lengths of the first and second branch lines L1 and L2 after the branch point. Thus, it is ideal that the first and second reference voltages Vpre1 and Vpre2 have the same voltage level. However, because a variation in the voltage drop between the branch lines L1 and L2 increases as the power circuit DC-DC is far away from the branch point, the first and second reference voltages Vpre1 and Vpre2 may have different voltage levels.

The first and second branch lines L1 and L2 may be respectively connected to buffers AMP1 and AMP2. Each of the buffers AMP1 and AMP2 may be implemented as a unit gain amplifier. However, because there is an offset variation between the buffers AMP1 and AMP2, voltage levels passing through the buffers AMP1 and AMP2 may be different from each other.

When the first and second reference voltages Vpre1 and Vpre2 are applied to the display panel as it is, they may make the initialization of the pixels non-uniform, thereby generating a luminance difference between the pixels. However, the aspect of the disclosure distributes spatially or temporally the first and second reference voltages Vpre1 and Vpre2 using a switch circuit SC shown in FIGS. 1 to 3, as a value equal to or less than a visual resolution of a viewer when viewing the display panel at a viewing distance. Thus, the viewer does not perceive the luminance difference even if the reference voltages of the different levels are applied to adjacent subpixels. The aspect of the disclosure can improve the uniformity of image quality perceived by the viewer even in the display device, in which the initialization of the subpixels is non-uniform, by distributing spatially or temporally the first and second reference voltages Vpre1 and Vpre2.

As shown in FIG. 3, the display device may include a plurality of power circuits DC-DC1 and DC-DC2. The first power circuit DC-DC1 outputs a first reference voltage Vpre1 to a first Vpre line L3, and the second power circuit DC-DC2 outputs a second reference voltage Vpre2 to a second Vpre line L4. The first and second Vpre lines L3 and L4 may be respectively connected to the buffers AMP1 and AMP2. It is ideal that the first and second reference voltages Vpre1 and Vpre2 have the same voltage level. However, the first and second reference voltages Vpre1 and Vpre2 may have different voltage levels due to a variation between the power circuits DC-DC1 and DC-DC2.

A plurality of first branch lines L11 and L12 is connected to the first Vpre line L3 to divides a path of the first reference voltage Vpre1 into a plurality of paths. A plurality of second branch lines L21 and L22 is connected to the second Vpre line L4 to divide a path of the second reference voltage Vpre2 into a plurality of paths.

The switch circuit SC is connected between the first and second Vpre lines L3 and L4, and the panel lines PL1 and PL2 to changes a path between the branch lines L11 to L22 and the panel lines PL1 and PL2 in response to a switch control signal. As shown in FIGS. 11A to 11C and FIGS. 12 to 14, the switch circuit SC may change a path between the branch lines L11 to L22 and the panel lines PL1 and PL2 at intervals of one or two horizontal periods and may change a path between the branch lines L11 to L22 and the panel lines PL1 and PL2 in each frame period.

The switch circuit SC includes a first switch circuit connected between the branch lines L11 and L12, and the panel lines PL1 and PL2 to switch the path between the branch lines L11 and L12, and the panel lines; and a second switch circuit connected between the branch lines L21 and L22, and the panel lines PL1 and PL2 to switch the path between the branch lines L21 and L22, and the panel lines PL1 and PL2.

The first switch circuit includes a first switch S1 connected between the first Vpre line L3 and the first panel line PL1 through a first branch line L11, and a third switch S3 connected between the first Vpre line L3 and the second panel line PL2 through a second branch line L12. The second switch circuit includes a second switch S2 connected between the second Vpre line L4 and the first panel line PL2 through a third branch line L21, and a fourth switch S4 connected between the second Vpre line L4 and the second panel line PL2 through a fourth branch line L22. However, aspects of the disclosure are not limited thereto.

When the first switch S1 is turned on, the first Vpre line L3 is connected to the first panel line PL1. When the second switch S2 is turned on, the second Vpre line L4 is connected to the first panel line PL1. When the third switch S3 is turned on, the first Vpre line L3 is connected to the second panel line PL2. When the fourth switch S4 is turned on, the second Vpre line or L4 is connected to the second panel line PL2.

FIGS. 4A and 4B illustrate panel lines supplied with a reference voltage.

Referring to FIGS. 4A and 4B, Vpre lines L1 and L2 supplied with a reference voltage Vpre are connected to panel lines PL. A switch circuit SC is disposed between the Vpre lines L1 and L2 and the panel lines PL and switches a path of the reference voltage Vpre. Buffers AMP1 and AMP2 may be connected between the Vpre lines L1 and L2 and the switch circuit SC. As shown in FIGS. 1 and 2, the Vpre lines L1 and L2 may be separated from an output terminal of one power circuit DC-DC. As shown in FIG. 3, the Vpre lines L1 and L2 may be respectively connected to the power circuits DC-DC1 and DC-DC2 and may independently receive the reference voltage Vpre.

The first and second reference voltages Vpre1 and Vpre2 are supplied to the subpixels through the switch circuit SC and the panel lines PL. The switch circuit SC switches a path of each of the first and second reference voltages Vpre1 and Vpre2. Hence, as shown in FIGS. 11A to 11C and FIGS. 12 to 14, the switch circuit SC may change a position of a subpixel 1 supplied with the first reference voltage Vpre1 and a position of a subpixel 2 supplied with the second reference voltage Vpre2 through various methods.

As shown in FIG. 4A, the panel lines PL may be connected to the subpixels without being separated inside the screen of a display panel PNL. In case of a large-screen display device, as shown in FIG. 4B, each of the panel lines PL may be separated up and down and divided into two parts inside the screen of the display panel PNL, in order to reduce RC load of the panel lines PL. The panel lines PL may be sensing lines connected to a source of a driving thin film transistor (TFT).

As shown in FIG. 4B, when the first reference voltage Vpre1 is applied to upper panel lines PLU and the second reference voltage Vpre2 is applied to lower panel lines PLD in the display panel PNL in which each panel line PL is divided into two parts inside the screen, a luminance difference between an upper half screen AU and a lower half screen AD may appear. This is because pixels of the upper half screen AU and pixels of the lower half screen AD are differently initialized. The aspect of the disclosure supplies the first and second reference voltages Vpre1 and Vpre2 to the pixels of each of the upper half screen AU and the lower half screen AD using the switch circuit SC and distributes the first and second reference voltages Vpre1 and Vpre2 in various manners shown in FIGS. 11A to 14, so that an initialization difference between the subpixels may not be recognized.

Figure 5:
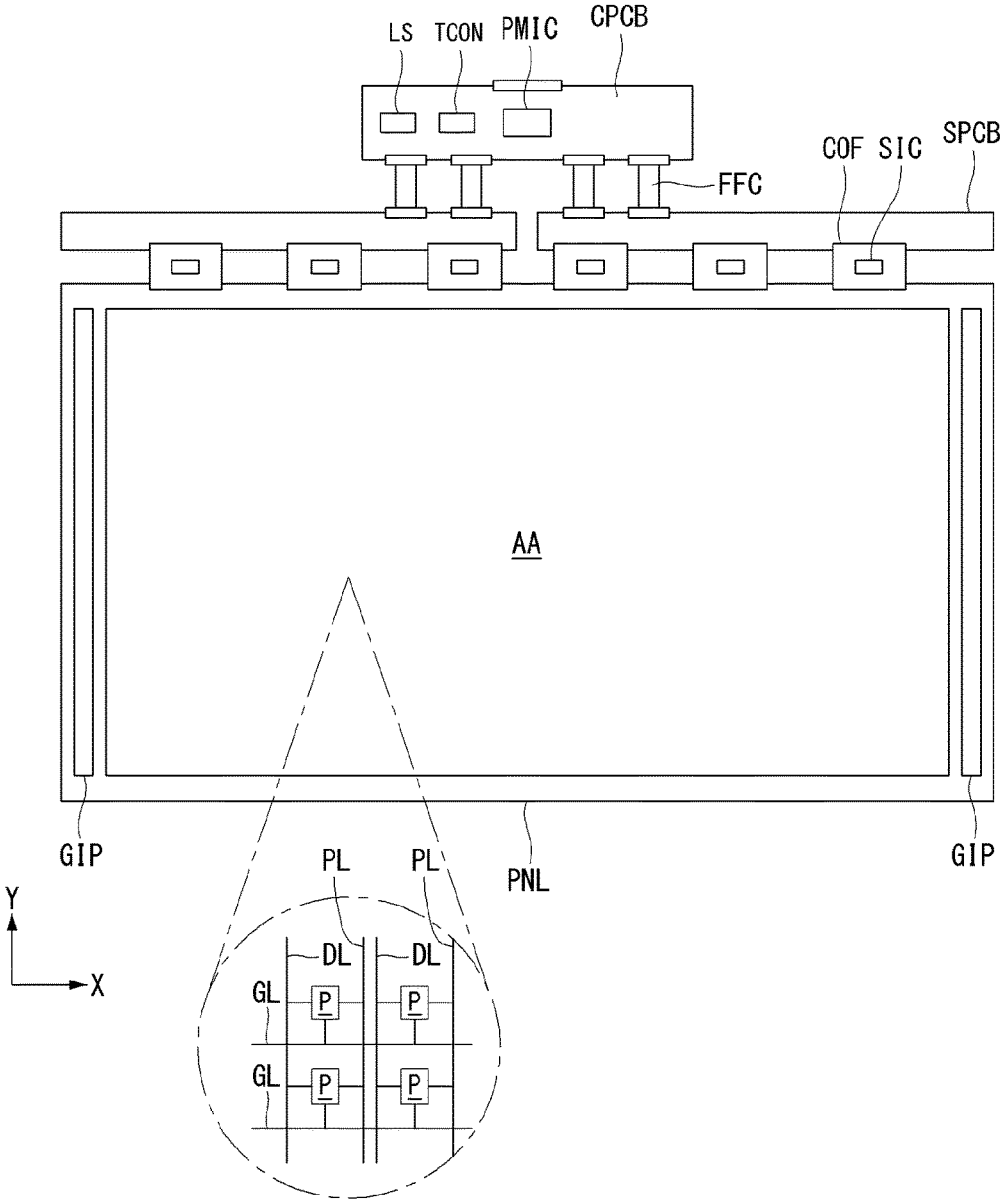
FIG. 5 illustrates a display device according to an aspect of the disclosure.
Figure 6:
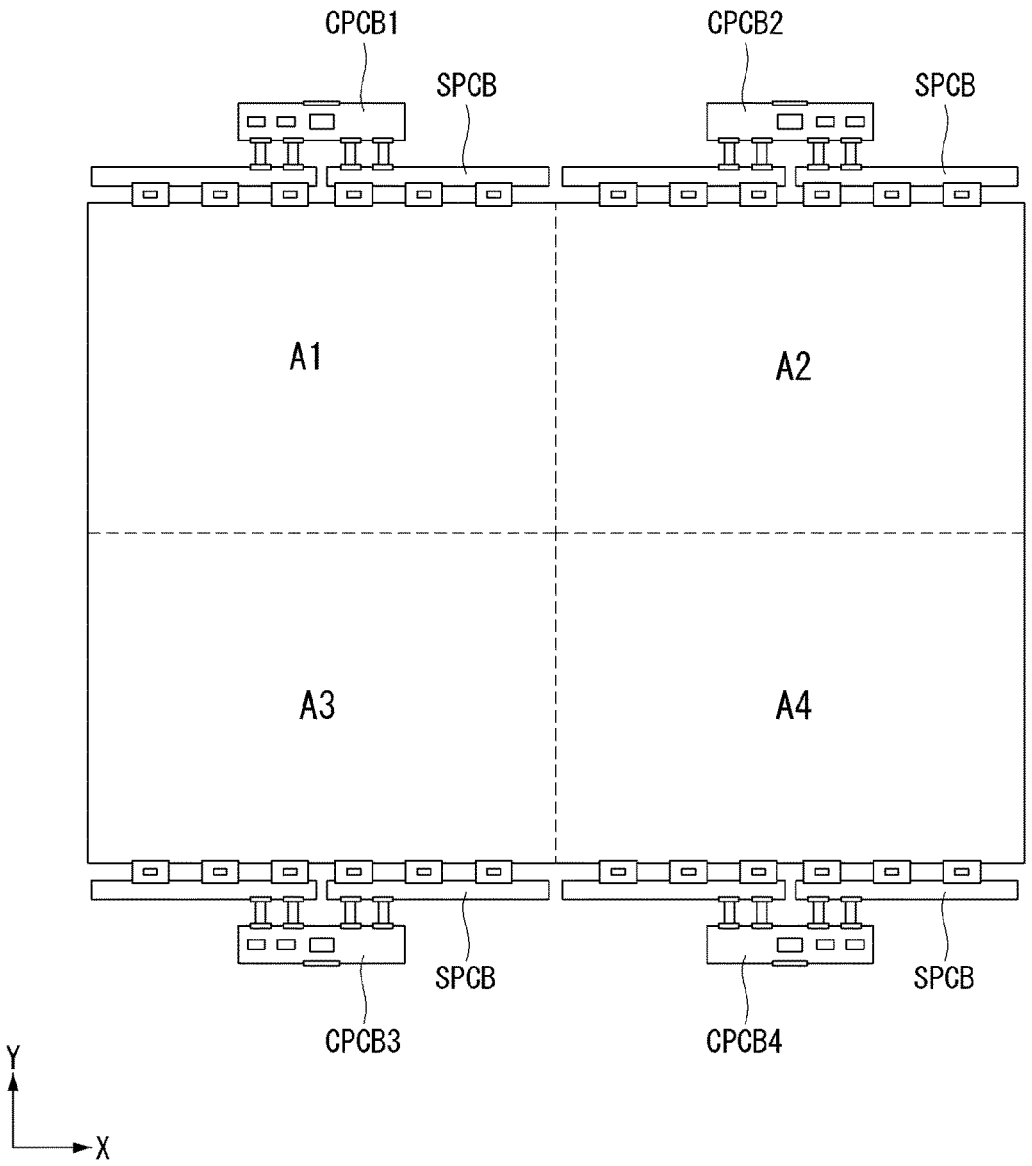
FIG. 6 illustrates an example of a large-screen display device.
Figure 7:
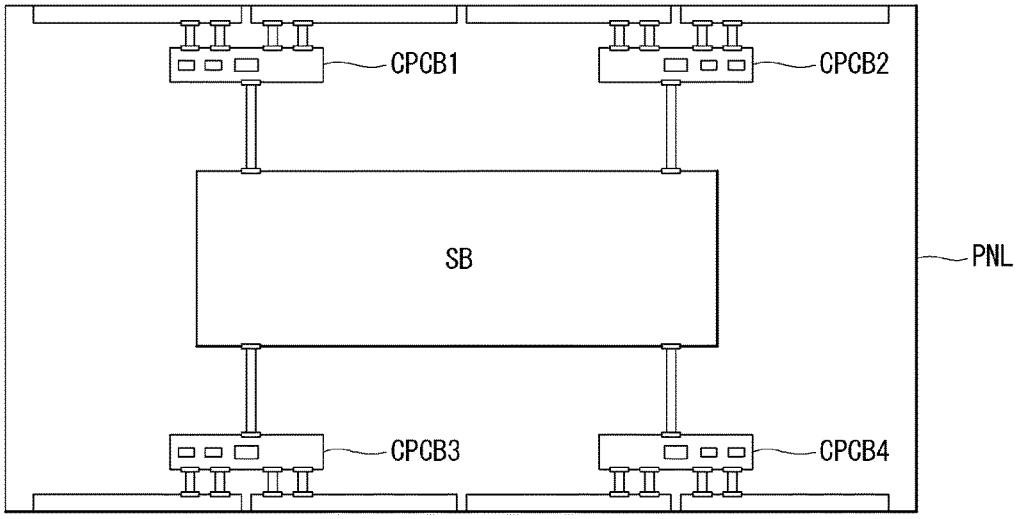
FIG. 7 illustrates a system board connected to a control board behind a display panel.

FIG. 5 illustrates a display device according to an aspect of the disclosure. FIG. 6 illustrates an example of a large-screen display device. FIG. 7 illustrates a system board connected to a control board behind a display panel.

Referring to FIGS. 5 to 7, a display device according to an aspect of the disclosure includes a display panel PNL and a driver circuit for writing data of an input image to the display panel PNL.

The driver circuit includes a data driver circuit supplying a data voltage of an input image to data lines DL of the display panel PNL, a scan driver circuit (or referred to as "gate driver circuit") sequentially supplying a scan signal (or referred to as "gate pulse") synchronized with the data voltage to scan lines (or referred to as "gate lines") GL of the display panel PNL, and a timing controller TCON for controlling operation timings of the data driver circuit and the scan driver circuit.

The screen of the display panel PNL includes a pixel array AA on which the input image is displayed. The pixel array AA includes pixels arranged in a matrix form in accordance with a crossing structure of the data lines DL and the scan lines GL. The pixels may include red (R), green (G), and blue (B) subpixels P for color representation. The pixels may further include white (W) subpixels P. Each subpixel P may include a switching thin film transistor (TFT), a driving TFT, an organic light emitting diode (OLED), and the like. The driving TFT is a driving element controlling a current flowing in the OLED depending on data of the input image. Panel lines PL may be disposed in parallel with the data lines DL and connected to the subpixels P.

A source driver integrated circuits (ICs) SIC may include the data driver circuit. Each source driver IC may be mounted on a chip-on-film (COF). The COF is attached to a data pad of the display panel PNL using an anisotropic conductive film (ACF). The data pads are connected to the data lines DL. The data driver circuit samples digital data of the input image received from the timing controller TCON. The data driver circuit converts the sampled digital data into gamma compensation voltages using a digital-to-analog converter (DAC) and generates the data voltages. The data driver circuit outputs the data voltages to the data lines DL.

The data driver circuit may further include a switch circuit SC shown in FIGS. 1 to 3 and a part (for example, an analog-to digital (ADC), an integrator, etc.) of a sensing circuit necessary for driving characteristics of the pixels.

The scan driver circuit may be directly formed on a substrate of the display panel PNL through a gate-in-panel (GIP) process and connected to the scan lines GL. The scan driver circuit may be implemented as an IC and attached to scan pads of the display panel PNL using an ACF by a tape automated bonding (TAB) process. The scan pads are connected to the scan lines GL. The scan driver circuit sequentially supplies the scan lines GL with the scan signals synchronized with the data voltage using a shift register that receives a start pulse and a shift clock and sequentially generates an output in synchronization with clock timing. In FIG. 5, "GIP" denotes the scan driver circuit (hereinafter, referred to as "GIP circuit") directly formed on the substrate of the display panel PNL.

The timing controller TCON receives the digital data of the input image from a system board SB (shown in FIG. 7) and transmits the digital data to the source driver IC SIC. The timing controller TCON receives timing signals, such as a vertical sync signal, a horizontal sync signal, a data enable signal, and a main clock signal, and generates timing control signals for controlling operation timings of the source driver IC SIC and the GIP circuit. The timing controller TCON generates a switch control signal for controlling operation timing of the switch circuit SC shown in FIGS. 1 to 4B.

The timing controller TCON multiplies an input frame frequency by N (where N is a positive integer equal to or greater than 2) to obtain a frame frequency and can control the driver circuit of the display panel PNL based on the frame frequency. The input frame frequency is 50 Hz set by the phase alternate line (PAL) method and is 60 Hz set by the national television standards committee (NTSC) method.

The timing controller TCON, a level shifter LS, a PMIC, etc. are mounted on a control board CPCB. The control board CPCB may be connected to a source printed circuit board (PCB) SPCB through a flexible flat cable (FFC) and may be connected to the system board SB through an FFC. A gate timing control signal such as the start pulse and the shift clock required to drive the GIP circuit, a gate high voltage VGH, and a gate low voltage VGL may be supplied to the GIP circuit through dummy lines formed on the COFs and the lines formed on the substrate of the display panel PNL.

In case of a large-screen display device, as shown in FIG. 6, a screen is divided into four parts A1 to A4, and the driver circuit is connected to each of the divided screens A1 to A4. The control board CPCB and the source PCB SPCB may be disposed on a back surface of the display panel PNL by bending the COFs. As shown in FIG. 7, a plurality of control boards CPCB1 to CPCB4 and the system board SB are connected to one another through the FFC on the back surface of the display panel PNL. The system board SB distributes data of the input image to the plurality of control boards CPCB and synchronizes operations of the control boards CPCB.

The PMIC, in which a power circuit is embedded, may be mounted on each of the control boards CPCB1-CPCB4. The first power circuit DC-DC1 of FIG. 3 may be disposed on one of the control boards CPCB1 and CPCB2, and the second power circuit DC-DC2 of FIG. 3 may be disposed on the other control board.

The system board SB may include a tuner for receiving a broadcast signal, an external device interface connected to an external device, a user interface for receiving user input, and the like. The system board SB may be connected to a power supply device (not shown). The system board SB is connected to the control board CPCB and transmits digital data of the input image and the timing signals to the control board CPCB. Further, the system board SB supplies an input power to the PMIC.

The gate timing control signal such as the start pulse and the shift clock generated in the timing controller TCON is transmitted to the GIP circuit through the level shifter LS. The level shifter LS shifts a voltage level of the gate timing control signal and changes the voltage level of the gate timing control signal to a voltage level swinging between the gate high voltage VGH and the gate low voltage VGL. The level shifter LS then transmits the gate timing control signal to the shift register of the GIP circuit. The gate high voltage VGH is set to a voltage equal to or greater than a threshold voltage of the switching TFT included in each subpixel. The gate low voltage VGL is set to a voltage less than the threshold voltage of the switching TFT. The switching TFT is turned on in response to the VGH of the scan signal and is turned off in response to the VGL of the scan signal. The GIP circuit shifts the scan signal of the VGH in response to the start pulse and the shift clock and sequentially outputs the scan signals to the scan lines.

Figure 8:
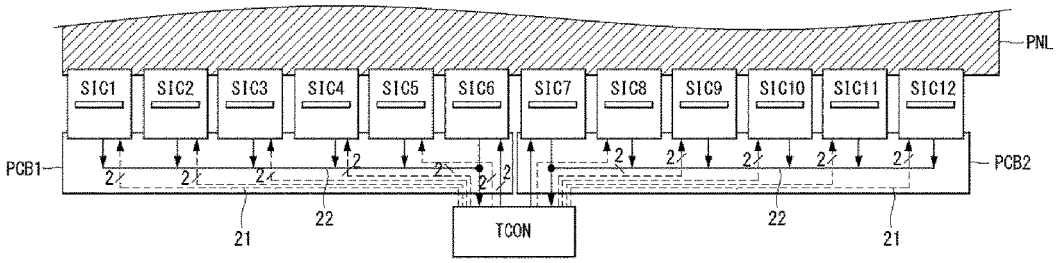
FIG. 8 illustrates in detail a connection of lines between a timing controller and source driver integrated circuits (ICs) in a display device according to an aspect of the disclosure.

FIG. 8 illustrates in detail a connection of lines between the timing controller and source driver ICs in the display device according to the aspect of the disclosure.

Referring to FIG. 8, each of source driver ICs SIC1 to SIC12 receives digital data of an input image from the timing controller TCON through a first data line pair 21 and transmits ADC data to the timing controller TCON through a second data line pair 22.

In the following description, pixels, of which driving characteristics are sensed, indicate at least one of a normal pixel which is disposed inside the screen and receives pixel data of an input image, and a dummy pixel disposed outside the screen. The dummy pixel may be disposed on the display panel PNL for the purpose of indirectly sensing change in driving characteristics of the normal pixel. The dummy pixel may have the same or similar structure as the normal pixel. The driving characteristics of the pixel indicate driving characteristics of components (e.g., a driving element, an OLED, etc.) constituting the pixel. For example, the driving characteristics of the pixel include change in a threshold voltage and change in mobility in a transistor used as the driving element, or change in a threshold voltage of the OLED, and the like. In the following description, aspects of the present disclosure are described using a driving TFT as an example of the transistor used as the driving element.

A sensing circuit is driven in response to a sensing timing signal and senses the driving characteristics of the pixel. The sensing circuit includes panel lines (or sensing lines) between the pixels and an ADC, one or more switching elements between the panel lines and the ADC, a sampling circuit, an integrator, and the like. In a voltage sensing method, the integrator may be omitted. Configuration of the sensing circuit may be variously changed depending on a sensing parameter and a sensing method. The sensing circuit may be disposed on the display panel PNL, and at least a portion of the sensing circuit may be embedded in the source driver IC. Because the scan driver circuit outputs the scan signal necessary for a sensing operation in the sensing mode, the scan driver circuit operates as the sensing circuit in the sensing mode.

The ADC data transmitted to the timing controller TCON includes driving characteristic sensing information of the subpixel obtained through the sensing circuit. At least a portion of the sensing circuit, for example, the sensing lines, the switching element, etc., may be arranged in the pixel array of the screen. The source driver ICs SIC1 to SIC12 may include a portion of the sensing circuit, for example, the ADC, the integrator, and the like. The scan driver circuit generates the scan signal necessary for the sensing operation in the sensing mode and thus operates as the sensing circuit.

Figure 9:
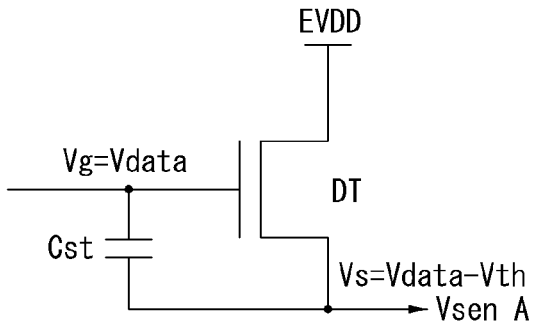
FIG. 9 illustrates a principle of a method of sensing a threshold voltage of a driving element.
Figure 9:
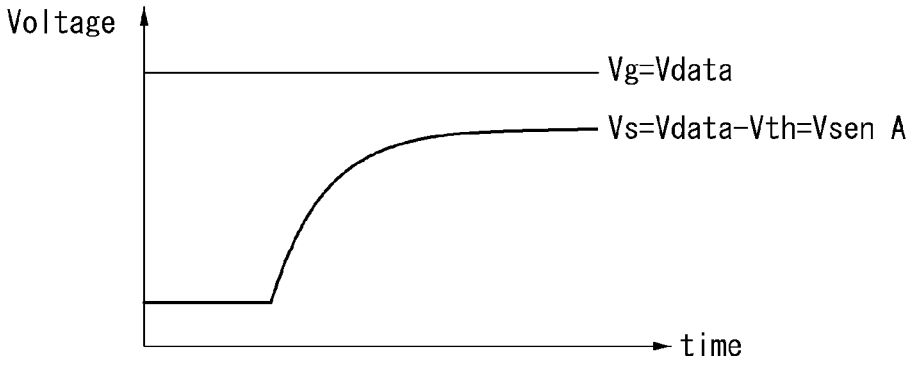
Figure 10:
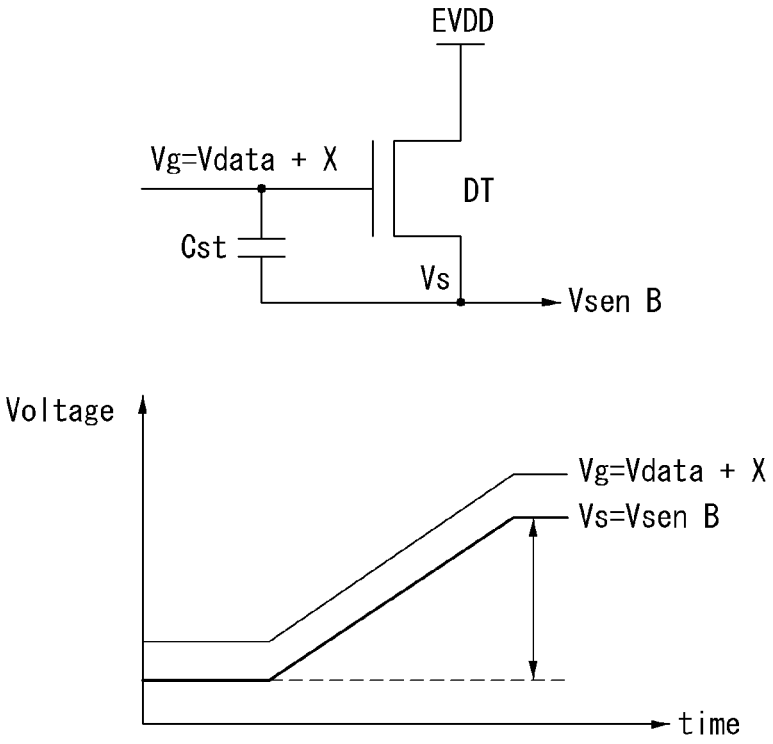
FIG. 10 illustrates a principle of a method of sensing mobility of a driving element.

FIGS. 9 and 10 schematically illustrate a principle of a method of sensing driving characteristics of a driving TFT. More specifically, FIG. 9 illustrates a method (hereinafter, referred to as "first sensing method") of sensing a threshold voltage of a driving TFT, and FIG. 10 illustrates a method (hereinafter, referred to as "second sensing method") of sensing mobility of a driving TFT.

Referring to FIG. 9, in the first sensing method, a sensing data voltage Vdata is supplied to a gate of a driving TFT DT, the driving TFT DT is operated using a source follower method, a source voltage Vs of the driving TFT DT is received as a sensing voltage Vsen A, and a threshold voltage Vth of the driving TFT DT is sensed based on the sensing voltage Vsen A. A capacitor Cst storing a gate-to-source voltage Vgs of the driving TFT DT is connected between the gate and a source of the driving TFT DT. The source voltage Vs of the driving TFT DT is expressed as follows: Vs=Vdata−Vth=Vsen A. The threshold voltage Vth of the driving TFT DT may be determined depending on a level of the sensing voltage Vsen A, and an offset value for compensating for change in the threshold voltage Vth of the driving TFT DT may be determined. The change in the threshold voltage Vth of the driving TFT DT may be compensated by adding the offset value to data of an input image. In the first sensing method, the threshold voltage Vth of the driving TFT DT has to be sensed after the gate-to-source voltage Vgs of the driving TFT DT operating as a source follower reaches a saturation state. Therefore, a relatively long time is required to sense the driving TFT DT. When the gate-to-source voltage Vgs of the driving TFT DT is saturated, a drain-to-source current of the driving TFT DT is zero.

Referring to FIG. 10, the second sensing method senses mobility μ of a driving TFT DT. In the second sensing method, a voltage Vdata+X greater than a threshold voltage of the driving TFT DT is applied to a gate of the driving TFT DT to turn on the driving TFT DT, and a source voltage Vs of the driving TFT DT charged for a predetermined time as a sensing voltage Vsen B is received accordingly. Where, X is a voltage obtained according to the compensation using an offset value. The mobility of the driving TFT DT is determined depending on a magnitude of the sensing voltage Vsen B, and a gain value for data compensation is obtained based on a sensing result of the mobility. The second sensing method senses the mobility of the driving TFT DT when the driving TFT DT operates in an active region. In the active region, the source voltage Vs of the driving TFT DT rises along its gate voltage Vg. Change in the mobility of the driving TFT DT can be compensated by multiplying data of an input image by the gain value. The second sensing method can reduce time required in the sensing because the mobility of the driving TFT DT is sensed in the active region of the driving TFT DT.

The sensing method according to aspects of the present disclosure may use a voltage sensing method of a driving TFT disclosed in Korean Patent Application Nos. 10-2013-0134256 (Nov. 6, 2013), 10-2013-0141334 (Nov. 20, 2013), 10-2013-0149395 (Dec. 3, 2013), 10-2013-0166678 (Dec. 30, 2013), 10-2014-0115972 (Sep. 2, 2014), 10-2015-0101228 (Jul. 16, 2015), 10-2015-0093654 (Jun. 30, 2015), 10-2015-0149284 (Oct. 27, 2015), and the like; a current sensing method of a driving TFT disclosed in Korean Patent Application Nos. 10-2014-0079255 (Jun. 26, 2014), 10-2015-0186683 (Dec. 24, 2015), 10-2015-0168424 (Nov. 30, 2015), and the like; and a method of sensing driving characteristics of an OLED display disclosed in Korean Patent Application Nos. 10-2014-0086901 (Jul. 10, 2014), 10-2014-0119357 (Sep. 5, 2014), 10-2014-0175191 (Dec. 8, 2014), 10-2015-0115423 (Aug. 17, 2015), 10-2015-0188928 (Dec. 29, 2015), 10-2015-0117226 (Aug. 20, 2015), and the like.

Figure 11A:
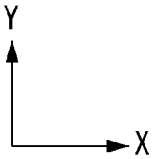
Figure 11B:
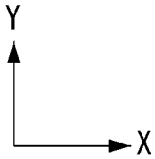
Figure 11C:
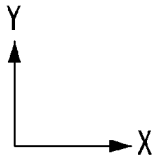
Figure 12:
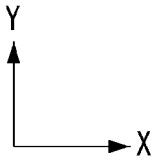
Figure 13:
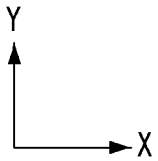

FIGS. 11A to 11C and FIGS. 12 to 14 illustrate a subpixel 1 (hereinafter referred to as "first subpixel") supplied with a first reference voltage Vpre1 and a subpixel 2 (hereinafter referred to as "second subpixel") supplied with a second reference voltage Vpre2. More specifically, FIGS. 11A to 11C illustrate an example where the first subpixels 1 and the second subpixels 2 are alternately arranged every one dot or two dots. In aspects disclosed herein, "one dot" indicates one subpixel. FIG. 12 illustrates an example where the first subpixels 1 and the second subpixels 2 are alternately arranged every one line of the display panel PNL. FIG. 13 illustrates an example where the first subpixels 1 and the second subpixels 2 are alternately arranged every one column of the display panel PNL. In aspects disclosed herein, "one line" includes subpixels arranged on one row of the screen of the display panel PNL along a horizontal direction X, and "one column" includes subpixels arranged on one column of the screen of the display panel PNL along a vertical direction Y. FIG. 14 illustrates an example where the first subpixels 1 and the second subpixels 2 are alternately arranged every one frame. One frame period is time required to write input image data corresponding to an amount of one frame to all the pixels constituting the screen. When a frame frequency (or frame rate) is 60 Hz, the screen updates data of 60 frames per second. In this instance, one frame period is 16.67 ms.

Referring to FIG. 11A, the first subpixels 1 and the second subpixels 2 are alternately arranged every one dot in each of the horizontal direction X and the vertical direction Y. Namely, one of two adjacent subpixels in each of the horizontal direction X and the vertical direction Y is the first subpixel 1 supplied with the first reference voltage Vpre1, and the other is the second subpixel 2 supplied with the second reference voltage Vpre2.

It is assumed that a first panel line PL1 is an odd-numbered panel line, and a second panel line PL2 is an even-numbered panel line. In order to supply the first and second reference voltages Vpre1 and Vpre2 to the subpixels as shown in FIG. 11A, the switch circuit SC operates as follows.

During a first horizontal period, the first and fourth switches S1 and S4 are turned on, and the second and third switches S2 and S3 are in an OFF-state under the control of the timing controller TCON. In this instance, the first reference voltage Vpre1 is applied to the first panel line PL1 through the first switch S1, and the second reference voltage Vpre2 is applied to the second panel line PL2 through the fourth switch S4. Thus, in the first horizontal period, the first subpixels 1 are odd-numbered subpixels connected to the first panel line PL1, and the second subpixels 2 are even-numbered subpixels connected to the second panel line PL2.

One horizontal period is the time required to write data to all the subpixels arranged on one line of the display panel PNL. Further, one horizontal period may be the time obtained by dividing one frame period by the number of lines of the display panel.

During a second horizontal period, the second and third switches S2 and S3 are turned on, and the first and fourth switches S1 and S4 are turned off under the control of the timing controller TCON. In this instance, the second reference voltage Vpre2 is applied to the first panel line PL1 through the second switch S2, and the first reference voltage Vpre1 is applied to the second panel line PL2 through the third switch S3. Thus, in the second horizontal period, the first subpixels 1 are subpixels connected to the second panel line PL2, and the second subpixels 2 are subpixels connected to the first panel line PL1.

During a third horizontal period, the switch circuit SC operates in the same manner as the first horizontal period. Subsequently, during a fourth horizontal period, the switch circuit SC operates in the same manner as the second horizontal period.

Referring to FIG. 11B, the first subpixels 1 and the second subpixels 2 are alternately arranged every one dot in the horizontal direction X and are alternately arranged every two dots in the vertical direction Y.

It is assumed that a first panel line PL1 is an odd-numbered panel line, and a second panel line PL2 is an even-numbered panel line. In order to supply the first and second reference voltages Vpre1 and Vpre2 to the subpixels as shown in FIG. 11B, the switch circuit SC operates as follows.

During first and second horizontal periods, the first and fourth switches S1 and S4 are turned on, and the second and third switches S2 and S3 are in an OFF-state under the control of the timing controller TCON. In this instance, the first reference voltage Vpre1 is applied to the first panel line PL1 through the first switch S1, and the second reference voltage Vpre2 is applied to the second panel line PL2 through the fourth switch S4. Thus, in the first and second horizontal periods, the first subpixels 1 are odd-numbered subpixels connected to the first panel line PL1, and the second subpixels 2 are even-numbered subpixels connected to the second panel line PL2.

During third and fourth horizontal periods, the second and third switches S2 and S3 are turned on, and the first and fourth switches S1 and S4 are turned off under the control of the timing controller TCON. In this instance, the second reference voltage Vpre2 is applied to the first panel line PL1 through the second switch S2, and the first reference voltage Vpre1 is applied to the second panel line PL2 through the third switch S3. Thus, in the third and fourth horizontal periods, the first subpixels 1 are subpixels connected to the second panel line PL2, and the second subpixels 2 are subpixels connected to the first panel line PL1.

Referring to FIG. 11C, the first subpixels 1 and the second subpixels 2 are alternately arranged every two dots in the horizontal direction X and are alternately arranged every one dot in the vertical direction Y.

In FIG. 11C, a first panel line PL1 may be (k+1)th and (4 k+2)th panel lines, and a second panel line PL2 may be (4 k+3)th and (4 k+4)th panel lines, where k is a positive integer. In this instance, two panel lines may be connected to each of the switches S1 to S4. In order to supply the first and second reference voltages Vpre1 and Vpre2 to the subpixels as shown in FIG. 11C, the switch circuit SC operates as follows.

During a first horizontal period, the first and fourth switches S1 and S4 are turned on, and the second and third switches S2 and S3 are in an OFF-state under the control of the timing controller TCON. In this instance, the first reference voltage Vpre1 is applied to the (4 k+1)th and (4 k+2)th panel lines through the first switch S1, and the second reference voltage Vpre2 is applied to the (4 k+3)th and (4 k+4)th panel lines through the fourth switch S4. Thus, in the first horizontal period, the first subpixels 1 are subpixels connected to the (4 k+1)th and (4 k+2)th panel lines, and the second subpixels 2 are subpixels connected to the (4 k+3)th and (4 k+4)th panel lines.

During a second horizontal period, the second and third switches S2 and S3 are turned on, and the first and fourth switches S1 and S4 are turned off under the control of the timing controller TCON. In this instance, the second reference voltage Vpre2 is applied to the (4 k+1)th and (4 k+2)th panel lines through the second switch S2, and the first reference voltage Vpre1 is applied to the (4 k+3)th and (4 k+4)th panel lines through the third switch S3. Thus, in the second horizontal period, the first subpixels 1 are subpixels connected to the (4 k+3)th and (4 k+4)th panel lines, and the second subpixels 2 are subpixels connected to the (4 k+1)th and (4 k+2)th panel lines.

During a third horizontal period, the switch circuit SC operates in the same manner as the first horizontal period. Subsequently, during a fourth horizontal period, the switch circuit SC operates in the same manner as the second horizontal period.

In each frame period, a switch control signal is inverted. Thus, in each frame period, positions of the first subpixels 1 and the second subpixels 2 shown in FIGS. 11A to 11C are reversed.

Referring to FIG. 12, the first subpixels 1 and the second subpixels 2 are alternately arranged every one line.

It is assumed that a first panel line PL1 is an odd-numbered panel line, and a second panel line PL2 is an even-numbered panel line.

During a first horizontal period, the first and third switches S1 and S3 are turned on, and the second and fourth switches S2 and S4 are in an OFF-state under the control of the timing controller TCON. In this instance, the first reference voltage Vpre1 is applied to the first panel line PL1 through the first switch S1, and the first reference voltage Vpre1 is applied to the second panel line PL2 through the third switch S3.

During a second horizontal period, the second and fourth switches S2 and S4 are turned on, and the first and third switches S1 and S3 are turned off under the control of the timing controller TCON. In this instance, the second reference voltage Vpre2 is applied to the first panel line PL1 through the second switch S2, and the second reference voltage Vpre2 is applied to the second panel line PL2 through the fourth switch S4.

During a third horizontal period, the switch circuit SC operates in the same manner as the first horizontal period. Subsequently, during a fourth horizontal period, the switch circuit SC operates in the same manner as the second horizontal period.

In each frame period, a switch control signal is inverted. Thus, in each frame period, positions of the first subpixels 1 and the second subpixels 2 shown in FIG. 12 are reversed.

Referring to FIG. 13, the first subpixels 1 and the second subpixels 2 are alternately arranged every one column.

It is assumed that a first panel line PL1 is an odd-numbered panel line, and a second panel line PL2 is an even-numbered panel line.

During every horizontal period of each odd-numbered frame period, the first and fourth switches S1 and S4 are turned on, and the second and third switches S2 and S3 are turned off under the control of the timing controller TCON. In this instance, the first reference voltage Vpre1 is applied to the first panel line PL1 through the first switch S1, and the second reference voltage Vpre2 is applied to the second panel line PL2 through the fourth switch S4. Thus, during the odd-numbered frame period, the first subpixels 1 are subpixels on odd-numbered columns, and the second subpixels 2 are subpixels on even-numbered columns.

In each frame period, a switch control signal is inverted. Thus, in each frame period, positions of the first subpixels 1 and the second subpixels 2 shown in FIG. 13 are reversed.

Referring to FIG. 14, the first subpixels 1 and the second subpixels 2 are alternately arranged every one frame period. During odd-numbered frame periods Fodd, the first reference voltage Vpre1 is applied to all the subpixels of the display panel PNL. During even-numbered frame periods Feven, the second reference voltage Vpre2 is applied to all the subpixels of the display panel PNL.

During every horizontal period of each odd-numbered frame period Fodd, the first and third switches S1 and S3 are turned on, and the second and fourth switches S2 and S4 are turned off under the control of the timing controller TCON.

The first reference voltage Vpre1 is applied to the first and second panel lines PL1 and PL2 through the first and third switches S1 and S3.

In each frame period, a switch control signal is inverted. Thus, in each frame period, positions of the first subpixels 1 and the second subpixels 2 shown in FIG. 14 are reversed.

The following aspects describe a method of initializing the subpixels using the reference voltages Vpre1 and Vpre2 and a method of using the panel lines PL1 and PL2.

Figure 15:
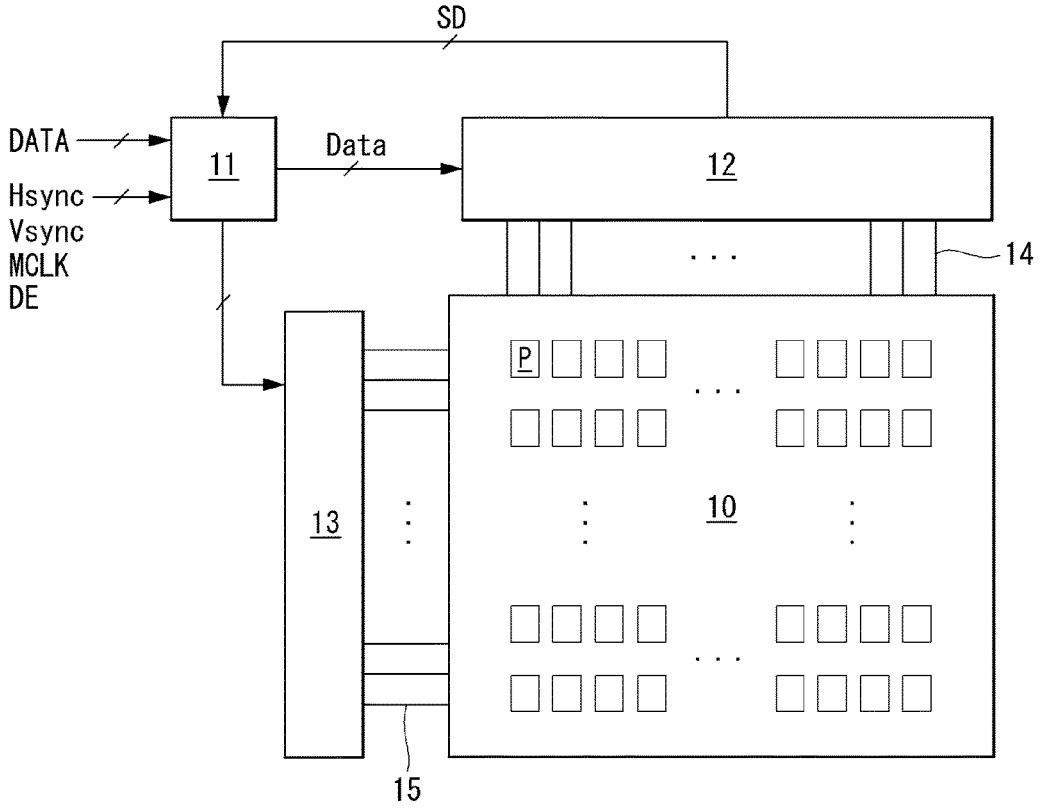
FIG. 15 is a block diagram schematically illustrating an organic light emitting diode (OLED) display according to an aspect of the disclosure.
Figure 16:
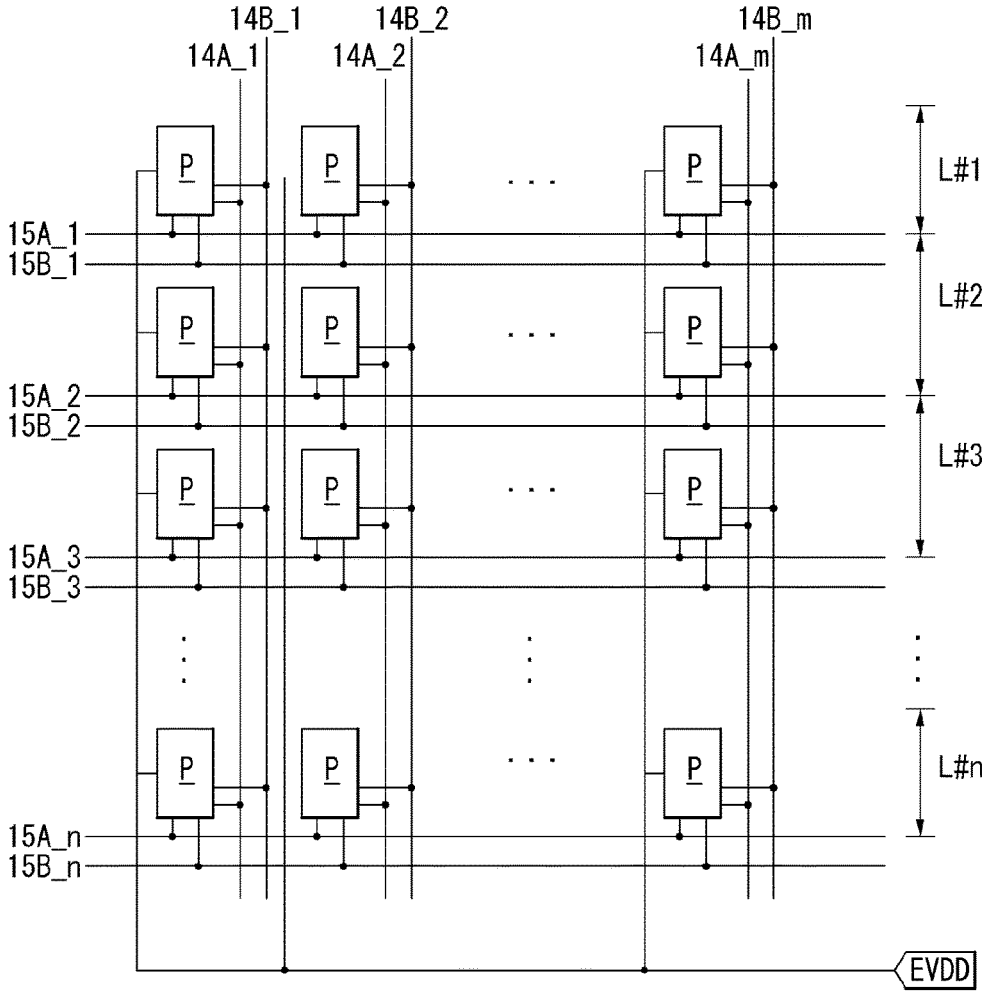
FIG. 16 illustrates a pixel array shown in FIG. 15.
Figure 17:
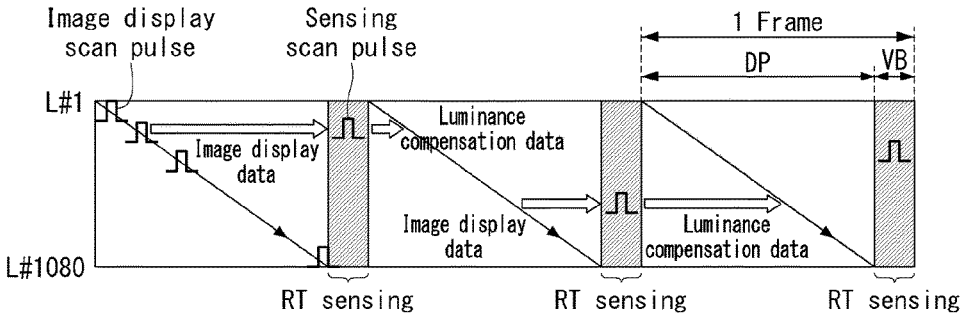
FIG. 17 illustrates a real-time sensing method performed in a vertical blanking interval.

FIGS. 15 and 16 schematically illustrate an OLED display according to an aspect of the disclosure. FIG. 17 illustrates a real-time sensing method (hereinafter referred to as "RT sensing method") performed in a vertical blanking interval.

A vertical blanking interval VB is the time between frames. Namely, the vertical blanking interval VB is time for which there is no input image data when the screen changes. In an active period following the vertical blanking interval VB, next frame data is input.

Referring to FIGS. 15 to 17, a display panel 10 includes a plurality of data lines 14, a plurality of scan lines 15 crossing the data lines 14, and a plurality of subpixels P respectively arranged at crossings of the data lines 14 and the scan lines 15 in a matrix. The data lines 14 include m data lines 14A_1 to 14A_m and m sensing lines 14B_1 to 14B_m, where m is a positive integer. The sensing lines 14B_1 to 14B_m are panel lines supplied with reference voltages Vpre1 and Vpre2. The scan lines 15 include n first scan lines 15A_1 to 15A_n and n second scan lines 15B_1 to 15B_n, where n is a positive integer.

Each subpixel P receives a high potential power EVDD and a low potential power EVSS from a power circuit. Each subpixel P may include an OLED, a driving TFT, first and second switching TFTs, a storage capacitor Cst, and the like. The TFTs constituting the subpixel P may be implemented as p-type or n-type metal-oxide semiconductor field effect transistors (MOSFETs). Further, semiconductor layers of the TFTs may include amorphous silicon, polycrystalline silicon, or oxide.

Each subpixel P is connected to one of the data lines 14A_1 to 14A_m, one of the sensing lines 14B_1 to 14B_m, one of the first scan lines 15A_1 to 15A_n, and one of the second scan lines 15B_1 to 15B_n.

The display panel 10 includes a plurality of lines L#1 to L#n implementing an image through the plurality of subpixels P. The lines L#1 to L#n of the display panel 10 are sequentially charged to an image display data voltage in response to an image display scan pulse in an image display period DP of one frame period. A line (hereinafter referred to as "sensing target line") to be sensed among the lines outputs a sensing voltage Vsen corresponding to change in electrical characteristics of the driving TFT included in each subpixel P in response to a sensing scan pulse during a vertical blanking interval VB excluding the image display period DP from one frame period and then is charged to a luminance compensation data voltage. An RT sensing method is performed on the sensing target line in the vertical blanking interval VB to sense driving characteristics of the subpixels. In aspects disclosed herein, the sensing target line may be selected as one line in each frame period and may be sequentially selected along a data scan direction. However, aspects of the disclosure are not limited thereto. For example, the sensing target line may be selected as one line in each frame period and may be non-sequentially selected among the lines irrespective of the data scan direction.

During the image display period DP, a scan driver circuit 13 sequentially supplies the image display scan pulses to the scan lines 15 connected to the subpixels P of the lines L#1 to L#n under the control of a timing controller 11. During the vertical blanking interval VB, the scan driver circuit 13 supplies the sensing scan pulse to the scan line 15 connected to the subpixels of the sensing target line under the control of the timing controller 11.

The image display scan pulses include first image display scan pulses sequentially supplied to the first scan lines 15A_1 to 15A_n and second image display scan pulses sequentially supplied to the second scan lines 15B_1 to 15B_n. The sensing scan pulse includes a first sensing scan pulse supplied to one first scan line connected to the sensing target line among the first scan lines 15A_1 to 15A_n and a second sensing scan pulse supplied to one second scan line connected to the sensing target line among the second scan lines 15B_1 to 15B_n.

A data driver circuit 12 includes a plurality of source driver ICs SIC. The data driver circuit 12 supplies data voltages required for a drive to the data lines 14A_1 to 14A_m, supplies a reference voltage to the sensing lines 14B_1 to 14B_m, and performs digital processing on a sensing voltage received through the sensing lines 14B_1 to 14B_m to supply the digital sensing voltage to the timing controller 11 under the control of the timing controller 11. The data voltages required for the drive include an image display data voltage, a sensing data voltage, a black display data voltage, a luminance compensation data voltage, and the like.

The data driver circuit 12 supplies the image display data voltage to the data lines connected to the subpixels of the lines L#1 to L#n in synchronization with the image display scan pulse and supplies the sensing data voltage, the black display data voltage, and the luminance compensation data voltage to the data lines 14A_1 to 14A_m connected to the subpixels of the sensing target line in synchronization with the sensing scan pulse. The image display data voltage indicates a data voltage, in which a compensation value for compensating for change in the electrical characteristics of the driving TFT is reflected. The compensation value may include an offset value and a gain value, but is not limited thereto.

The sensing data voltage indicates a data voltage applied to a gate electrode of the driving TFT, so as to turn on the driving TFT of each of the subpixels of the sensing target line. The black display data voltage indicates a data voltage applied to the gate electrode of the driving TFT, so as to turn off the driving TFT of each of the subpixels of the sensing target line. The luminance compensation data voltage indicates a data voltage used to recover a luminance of the sensing target line to an image display level immediately before the RT sensing and is selected at the same voltage level as the image display data voltage applied to the sensing target line in the image display period DP immediately before the RT sensing.

The timing controller 11 generates timing control signals for controlling operation timings of the data driver circuit 12, the scan driver circuit 13, and a sensing circuit based on timing signals, such as a vertical sync signal Vsync, a horizontal sync signal Hsync, a main clock MCLK, and a data enable signal DE. The timing controller 11 modulates image display digital data to be applied to the lines L#1 to L#n of the display panel 10 during the image display period DP, so as to compensate for change in driving characteristics of the subpixel based on sensing data SD supplied from the data driver circuit 12. Further, the timing controller 11 modulates luminance compensation digital data to be applied to the sensing target line during the vertical blanking interval VB, so as to compensate for a luminance variation between the sensing target line and other display line. The sensing data SD is digital data output through an ADC and is a result of sensing the driving characteristics of the subpixel. The image display digital data indicates data that is converted into the image display data voltage by the data driver circuit 12. The luminance compensation digital data indicates data that is converted into the luminance compensation data voltage by the data driver circuit 12. The timing controller 11 may modulate the input image data DATA and supplied the modulated Data to the data driver circuit 12.

Figure 18:
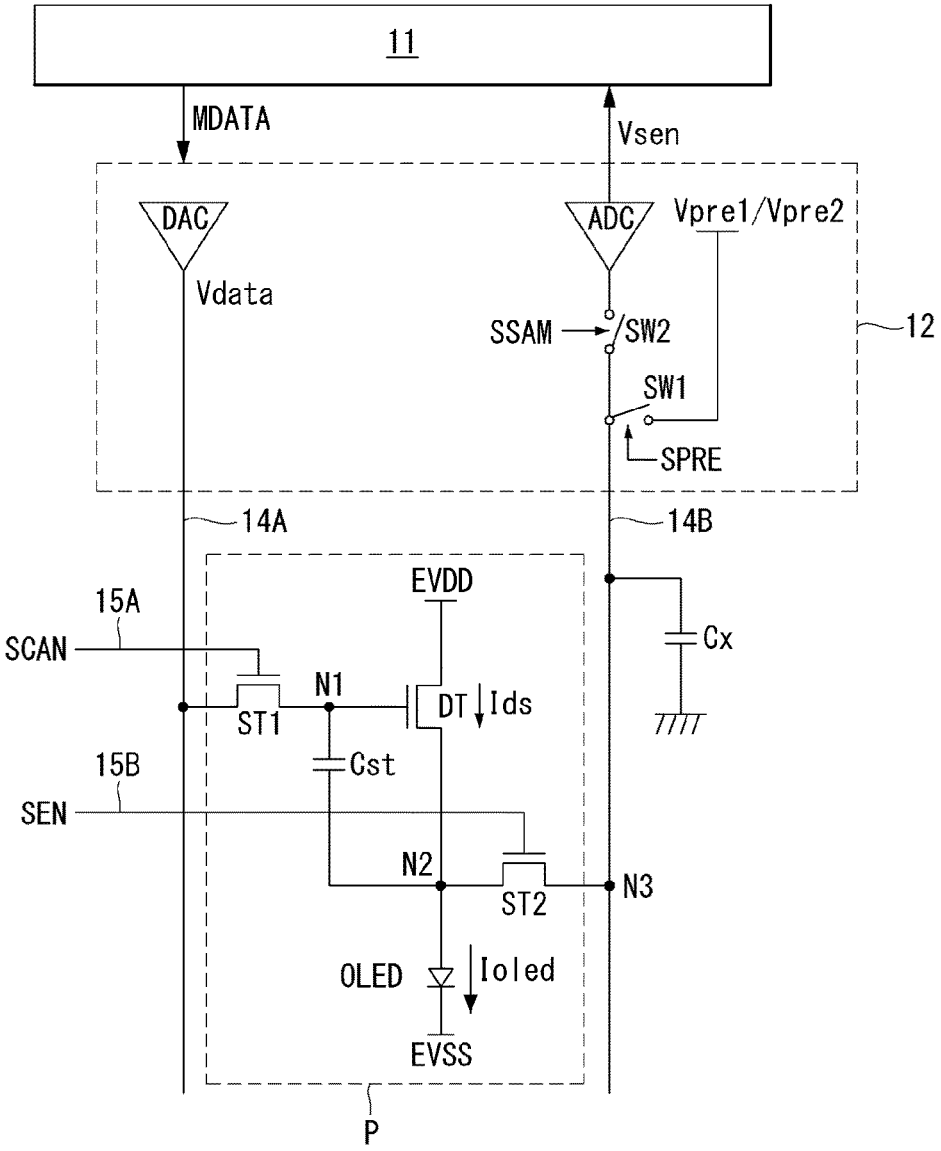
FIG. 18 illustrates in detail a connection structure of a timing controller, a data driver circuit, and a subpixel shown in FIG. 15.

FIG. 18 illustrates a connection structure of the timing controller 11, the data driver circuit 12, and a subpixel P. In FIG. 18, a first scan pulse SCAN may include a first image display scan pulse during the image display period DP and a first sensing scan pulse during the vertical blanking interval VB corresponding to a non-display period. Further, a second scan pulse SEN may include a second image display scan pulse during the image display period DP and a second sensing scan pulse during the vertical blanking interval VB.

Referring to FIG. 18, the subpixel P includes an OLED, a driving TFT DT, a storage capacitor Cst, a first switching TFT ST1, and a second switching TFT ST2.

The OLED includes an anode, a cathode, and an organic compound layer between the anode and the cathode. The organic compound layer may include a hole injection layer HIL, a hole transport layer HTL, an emission layer EML, an electron transport layer ETL, and an electron injection layer EIL, but is not limited thereto. The OLED emits light due to excitons generated by holes and electrons moving to the emission layer EML when a voltage equal to or greater than a threshold voltage of the OLED is applied between the anode and the cathode.

The driving TFT DT includes a gate electrode connected to a first node N1, a drain electrode connected to an input terminal of the high potential power EVDD, and a source electrode connected to the second node N2. The driving TFT DT controls a driving current Ioled flowing in the OLED depending on a gate-to-source voltage Vgs of the driving TFT DT. The driving TFT DT is turned on when the gate-to-source voltage Vgs is greater than a threshold voltage Vth. As the gate-to-source voltage Vgs increases, a current Ids flowing between the source electrode and the drain electrode of the driving TFT DT increases. When a source voltage of the driving TFT DT is greater than the threshold voltage of the OLED, the source-to-drain current Ids of the driving TFT DT, as the driving current Ioled of the OLED, flows through the OLED. As the driving current Ioled increases, an amount of light emitted by OLED increases. Hence, a descried gray scale is represented.

The storage capacitor Cst is connected between the first node N1 and the second node N2.

The first switching TFT ST1 includes a gate electrode connected to the first scan line 15A, a drain electrode connected to the data line 14A, and a source electrode connected to the first node N1. The first switching TFT ST1 is turned on in response to the first scan pulse SCAN and applies the data voltage Vdata charged to the data line 14A to the first node N1.

The second switching TFT ST2 includes a gate electrode connected to the second scan line 15B, a drain electrode connected to the second node N2, and a source electrode connected to the sensing line 14B. The second switching TFT ST2 is turned on in response to the second scan pulse SEN and electrically connects the second node N2 to the sensing line 14B.

The data driver circuit 12 is connected to the subpixel P through the data line 14A and the sensing line 14B. A sensing capacitor Cx for storing a source voltage of the second node N2 as the sensing voltage Vsen may be formed on the sensing line 14B. The data driver circuit 12 includes a digital-to-analog converter (DAC), an analog-to-digital converter (ADC), an initialization switch SW1, a sampling switch SW2, and the like.

The DAC receives digital data and generates data voltages Vdata required for the drive, i.e., the image display data voltage, the sensing data voltage, the black display data voltage, and the luminance compensation data voltage. The DAC outputs the data voltages Vdata to the data line 14A. The initialization switch SW1 is turned on in response to an initialization control signal SPRE and outputs the reference voltages Vpre1 and Vpre2 to the sensing line 14B. The sampling switch SW2 is turned on in response to a sampling control signal SSAM and supplies the ADC with the source voltage (as the sensing voltage Vsen) of the driving TFT DT, which is stored in the sensing capacitor Cx of the sensing line 14B for a predetermined time. The ADC converts an analog sensing voltage stored in the sensing capacitor Cx into a digital value (i.e., the sensing voltage Vsen) and supplies the sensing voltage Vsen to the timing controller 11. The sensing capacitor Cx may be provided as a separate capacitor or implemented as a parasitic capacitor connected to the sensing line 14B.

Figure 19:
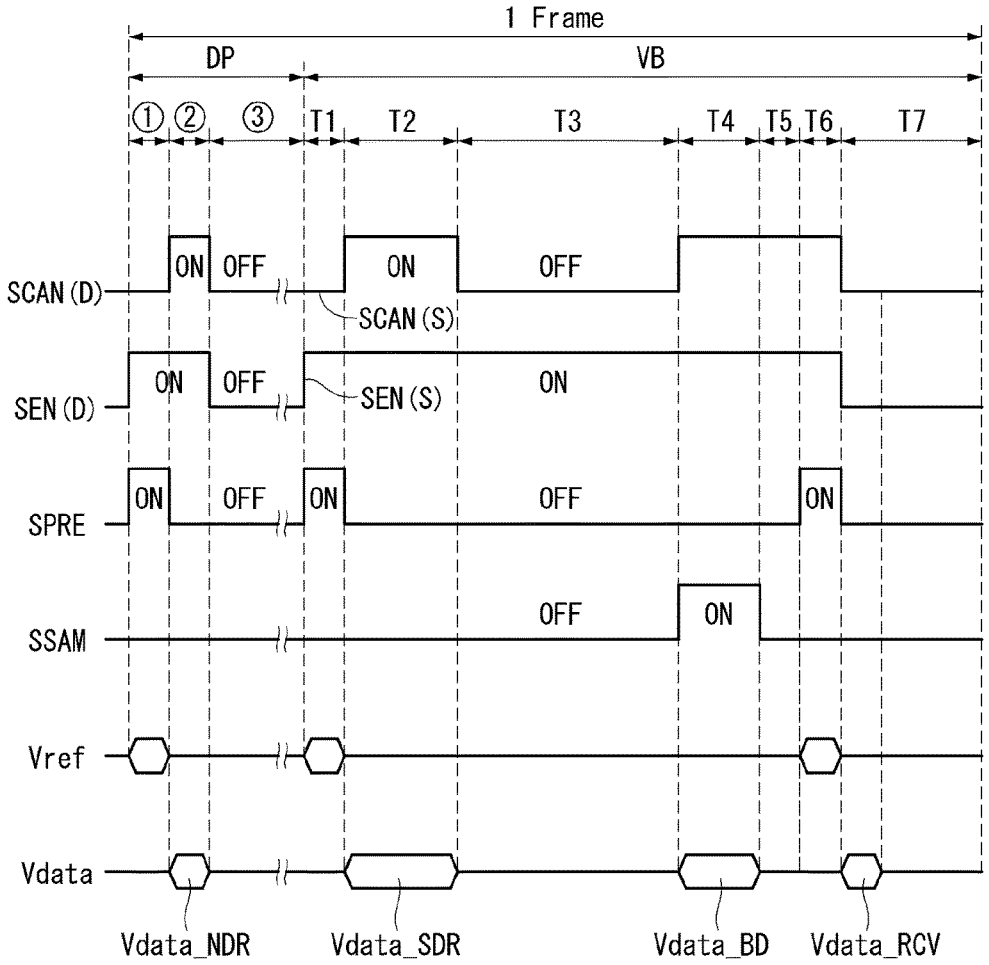
FIGS. 19 to 21 illustrate a luminance variation between subpixels.
Figure 20:
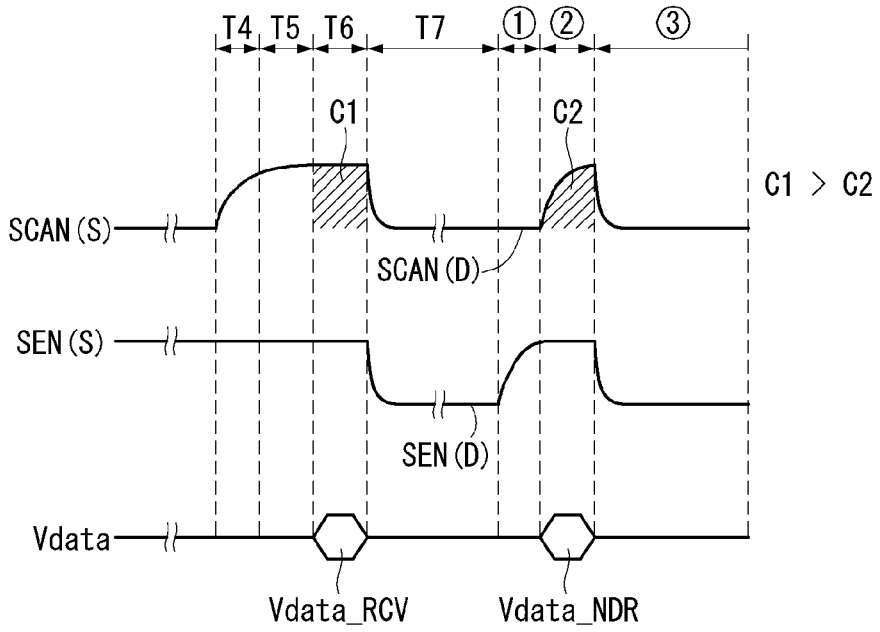

FIGS. 19 and 20 illustrate a luminance variation between subpixels.

More specifically, FIG. 19 illustrates a driving mode for reproducing an input image on the screen in the image display period DP and a sensing mode for sensing change in the electrical characteristics of the driving TFT and implementing the same luminance recovery image as an original image in the vertical blanking interval VB. In the driving mode, the subpixels P may be driven through an image display initialization period ①, an image display programming period ②, and an image display emission period ③. In sensing mode, the subpixels P may be driven through a sensing initialization period T1, a sensing programming period T2, a sensing period T3, a sampling period T4, a luminance compensation initialization period T5, a luminance compensation programming period T6, and a luminance compensation emission period T7.

Figure 21:
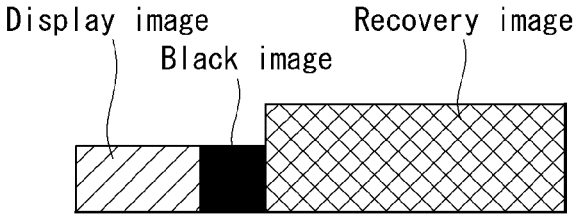

More specifically, shapes of image display scan pulses SCAN(D) and SEN(D) corresponding to the image display initialization period ① and the image display programming period ② are different from shapes of luminance compensation scan pulses SCAN(S) and SEN(S) corresponding to the luminance compensation initialization period T5 and the luminance compensation programming period T6. The difference of the pulse shape leads to a variation in an amount of charge of the subpixels P as shown in FIG. 20. Even if the pulse shapes in the image display programming period ② and the luminance compensation programming period T6 are equally set, a saturation portion of the first luminance compensation scan pulse SCAN(S) may be wider than a saturation portion of the first image display scan pulse SCAN(D). Therefore, a charge amount C1 of a luminance compensation data voltage Vdata_RCV charged to the gate electrode of the driving TFT during the luminance compensation programming period T6 may be more than a charge amount C2 of an image display data voltage Vdata_NDR charged to the gate electrode of the driving TFT during the image display programming period ②. Thus, as shown in FIG. 21, a luminance of a recovery image resulting from the luminance compensation data voltage Vdata_RCV having a relatively large charge amount C1 may be more than a luminance of a display image resulting from the image display data voltage Vdata_NDR having the relatively small charge amount C2.

As described above, when there is a luminance difference between the recovery image and the display image, a luminance variation is generated between the sensing target line, on which the RT sensing is performed, and a non-sensing target line, on which the RT sensing is not performed, during the same image frame. An amount of the luminance variation varies depending on a display location of the sensing target line. As the sensing target line approaches the lower part of the display panel, in which a display duty of the recovery image gradually increases, the amount of the luminance variation increases.

Figure 22:
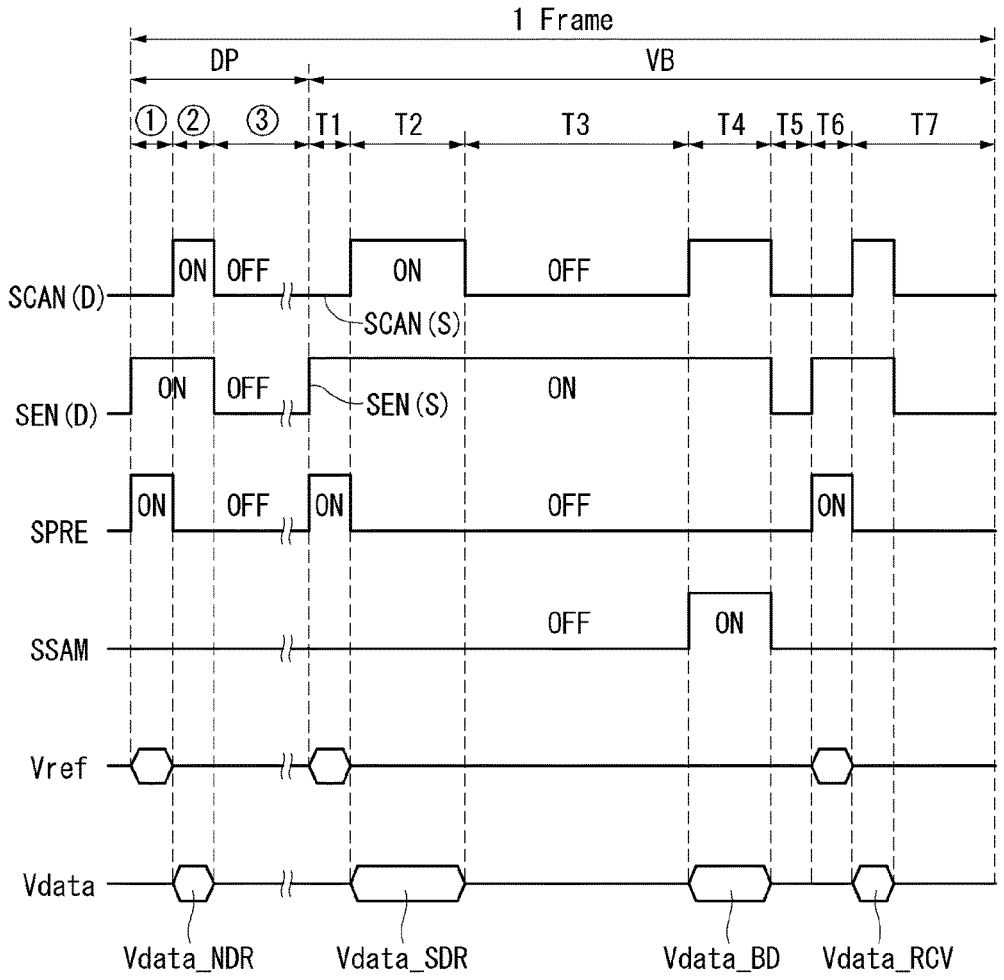
FIG. 22 is a waveform diagram illustrating a sensing timing signal for reducing a luminance variation between a display image and a recovery image.

In order to reduce the luminance variation between the sensing target line and the non-sensing target line, as shown in FIG. 22, the aspect of the disclosure can supply the image display scan pulse for charging the image display data voltage and the luminance compensation scan pulse for charging the luminance compensation data voltage in the same pulse shape.

Referring to FIG. 22, the shapes of the luminance compensation scan pulses SCAN(S) and SEN(S) corresponding to the luminance compensation initialization period T5 and the luminance compensation programming period T6 are similar to the shapes of the image display scan pulses SCAN(D) and SEN(D) corresponding to the image display initialization period ① and the image display programming period ②.

Figure 23:
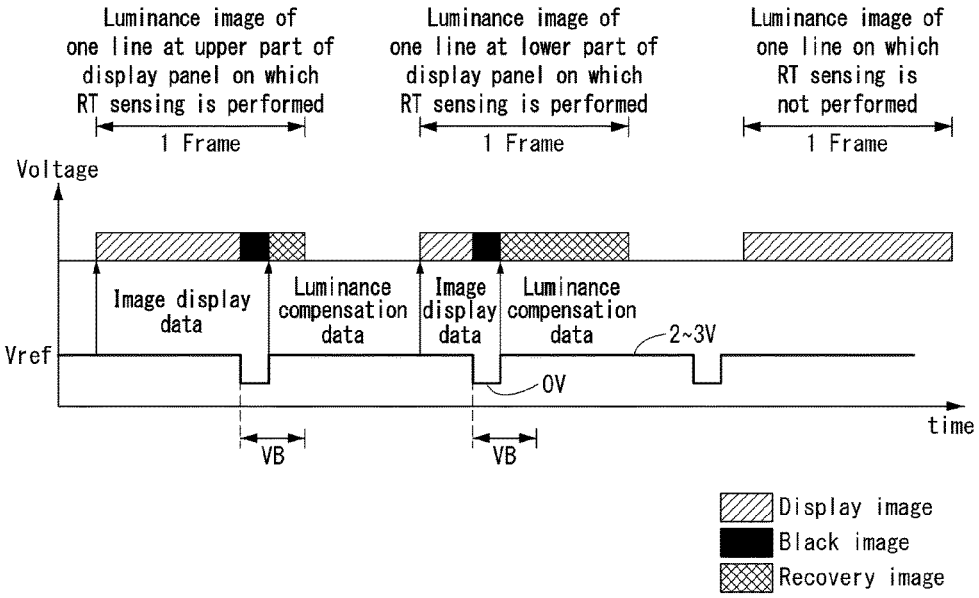
FIG. 23 illustrates an effect of a reduction in a luminance variation between a display image and a recovery image through a method of driving subpixels using a sensing timing signal of FIG. 22.

Hence, a saturation hold width of the first luminance compensation scan pulse SCAN(S) is equal to a saturation hold width of the first image display scan pulse SCAN(D). As a result, a charge amount C1 of the luminance compensation data voltage Vdata_RCV charged to the gate electrode of the driving TFT DT during the luminance compensation programming period T6 is the same as a charge amount C2 of the image display data voltage Vdata_NDR charged to the gate electrode of the driving TFT DT during the image display programming period ②. Further, as shown in FIG. 23, the recovery image resulting from the luminance compensation data voltage Vdata_RCV can implement the same luminance as the display image resulting from the image display data voltage Vdata_NDR. As a result, the luminance variation between the sensing target line and the non-sensing target line during the same image frame can be reduced.

Figure 24:
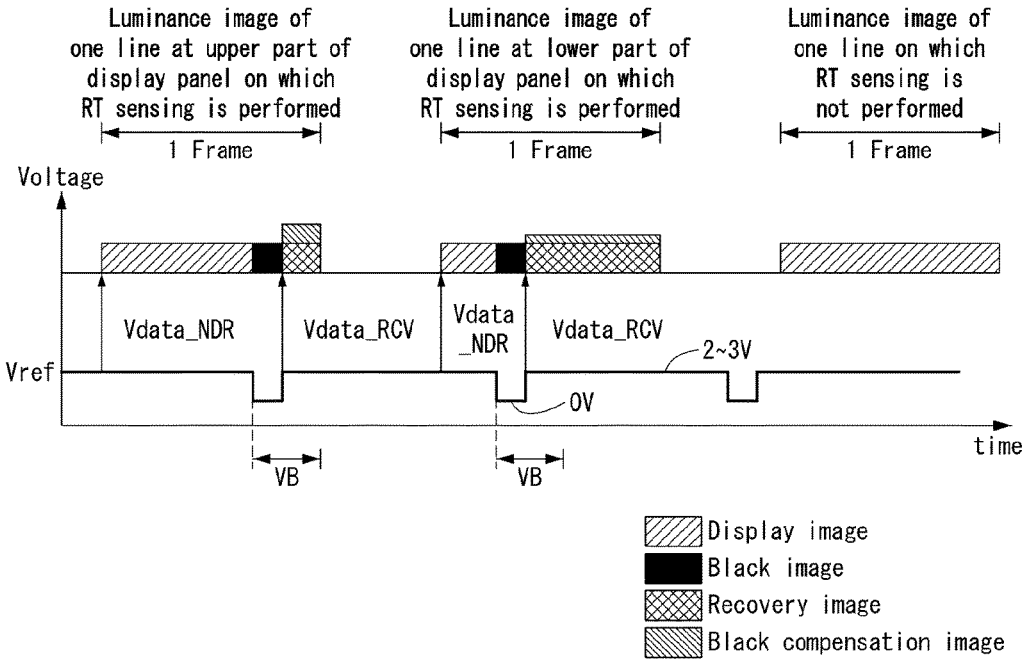
FIG. 24 illustrates a method for reducing a luminance variation between a sensing target line and a non-sensing target line by compensating for a luminance reduction resulting from a black image.
Figure 25:
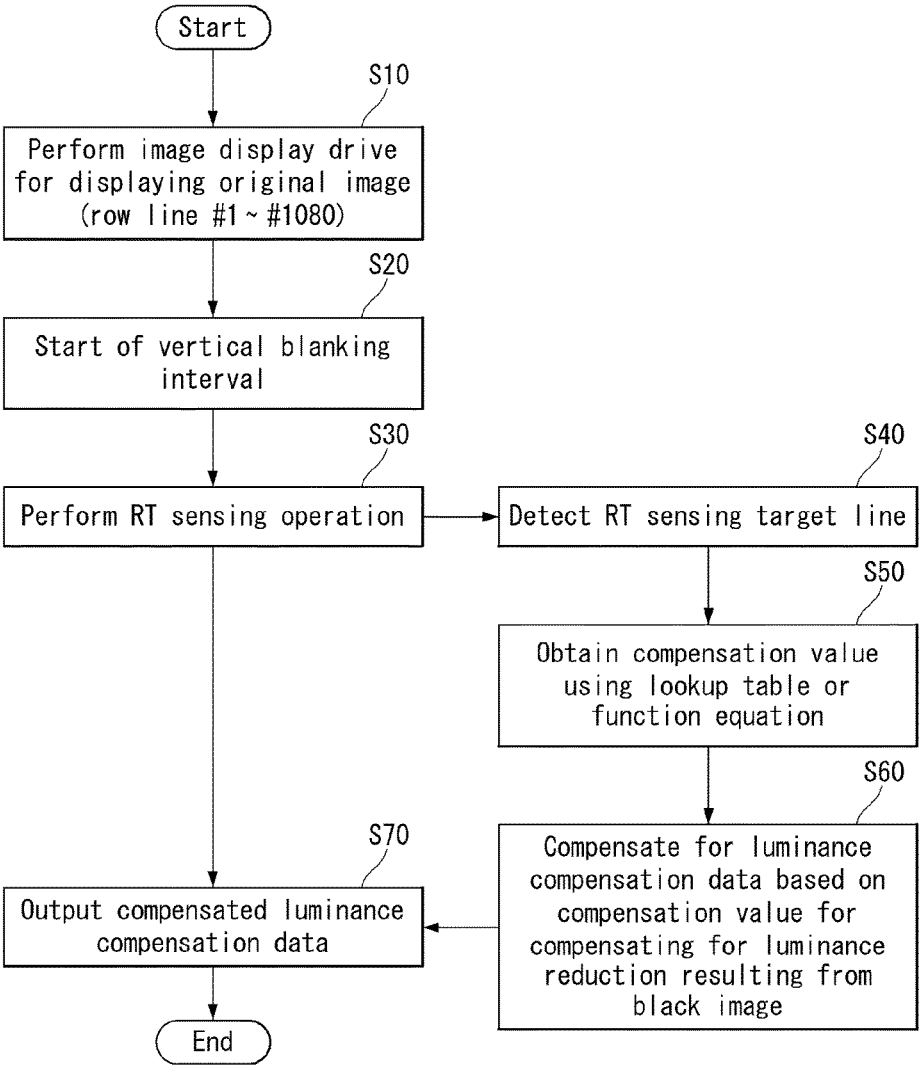
FIG. 25 is a flow chart illustrating a method of compensating for a luminance reduction resulting from a black image.

Referring to FIGS. 24 and 25, the timing controller 11 writes data of an input image to the subpixels P of all the lines of the display panel in an image display period DP of one frame period to perform an image display drive for displaying an original image in step S10. When the image display drive is completed and a vertical blanking interval VB of the one frame period starts in step S20, the timing controller 11 performs an RT sensing operation in step S30.

The timing controller 11 counts frame periods to determine how many frames there are before a current frame and determines a sensing target line, on which the RT sensing operation will be performed, in a vertical blanking interval VB of the current frame based on the determination result in step S40.

The timing controller 11 derives a compensation value which compensates for a luminance reduction resulting from a black image and is suitable for a location of the sensing target line. To this end, the timing controller 11 may use a lookup table, in which compensation values depending on each location of the sensing target line are previously stored, or may directly obtain the compensation value from a function equation of compensation values depending on each location of the sensing target line in step S50.

The timing controller 11 outputs luminance compensation data, that is compensated based on the compensation value, in steps S60 and S70. Hence, aspects can further reduce a luminance variation between the sensing target line and the non-sensing target line.

Figure 26:
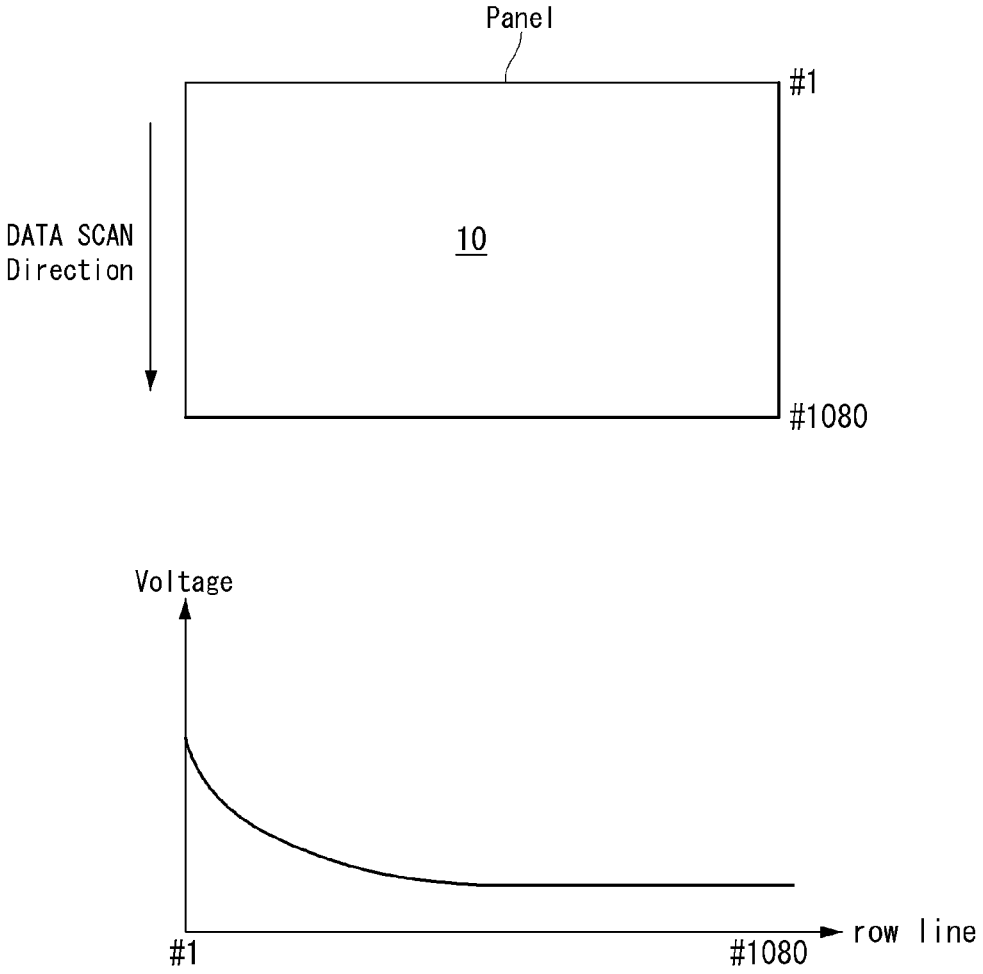
FIG. 26 illustrates an example where a compensation value for compensating for a luminance reduction resulting from a black image varies depending on a location of a line of a display panel.

The compensation value may vary depending on the location of the sensing target line. For example, as shown in FIG. 26, the compensation value may be set to a gradually decreasing value as the sensing target line goes from the first line L#1 of the display panel 10, to which data is first applied, to the last line L#1080 of the display panel 10, to which data is last applied.

Figure 27:
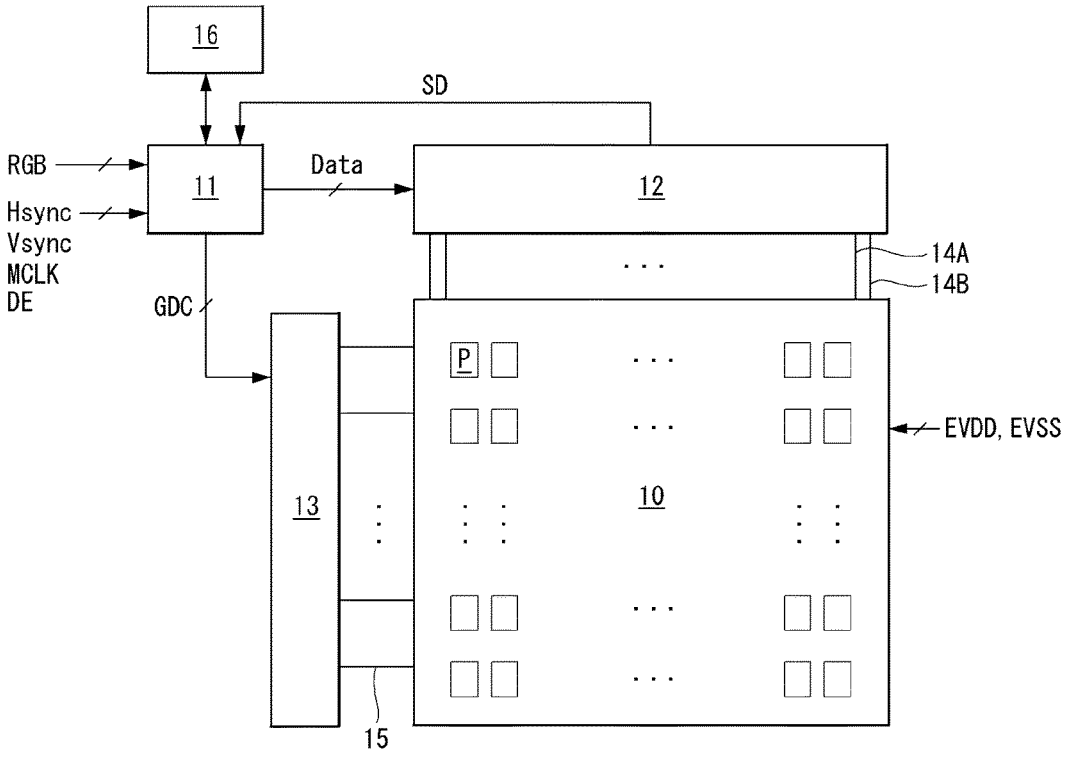
FIG. 27 illustrates an OLED display according to another aspect of the disclosure.
Figure 28:
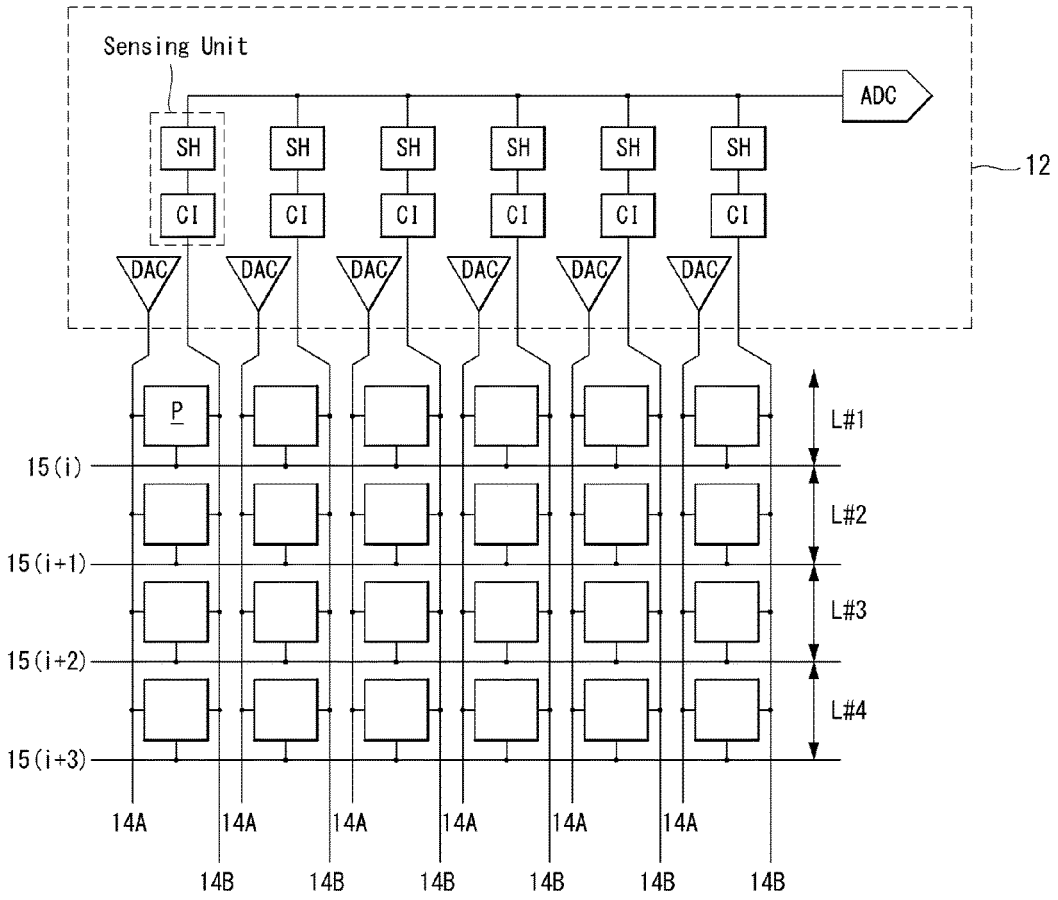
FIG. 28 illustrates a connection structure of subpixels of a display panel and source driver ICs.

FIGS. 27 and 28 illustrate an OLED display according to another aspect of the present disclosure.

Referring to FIGS. 27 and 28, a plurality of data lines 14A, a plurality of sensing lines 14B, and a plurality of scan lines 15 cross each other on a display panel 10, and subpixels P are arranged in a matrix form at their crossings.

Each subpixel P is connected to one of the data lines 14A, one of the sensing lines 14B, and one of the scan lines 15. The sensing lines 14B are panel lines described above. Each subpixel P is electrically connected to the data line 14A in response to a scan pulse input through the scan line 15 to receive a data voltage form the data line 14A and output a sensing signal through the sensing line 14B.

Each subpixel P receives a high potential driving voltage EVDD and a low potential driving voltage EVSS from a power circuit. Each subpixel P may include an OLED, a driving TFT, first and second switching TFTs, a storage capacitor, and the like. The TFTs constituting the subpixel P may be implemented as p-type or n-type transistors. Further, semiconductor layers of the TFTs may include amorphous silicon, polycrystalline silicon, or oxide.

Each subpixel P operates in a driving mode for an image display and a sensing mode for sensing driving characteristics of the subpixel P. The sensing mode may be performed for a predetermined time before the driving mode during a power-on sequence or performed in a vertical blanking interval VB in the driving mode.

A data driver circuit 12 includes a plurality of source driver ICs SIC. The data driver circuit 12 may include DACs connected to the data lines 14A, sensing units connected to the sensing lines 14B, and an ADC. In the driving mode, the DAC converts data RGB of an input image into a data voltage under the control of a timing controller 11 and supplies the data voltage to the data line 14A. In the sensing mode, the DAC generates a sensing data voltage under the control of the timing controller 11 and supplies the sensing data voltage to the data line 14A.

Each sensing unit includes a current integrator CI to which the current is input through the sensing line 14B and a sampling circuit SH for sampling and holding an output of the current integrator CI. The ADC of the data driver circuit 12 sequentially converts the outputs of the sampling circuits SH into digital data and transmits the digital data, as sensing data SD, to the timing controller 11.

In the driving mode, a scan driver circuit 13 generates an image display scan pulse under the control of the timing controller 11 and shifts the image display scan pulse. In the sensing mode, the scan driver circuit 13 generates a sensing scan pulse and shifts the sensing scan pulse. An ON-pulse portion of the sensing scan pulse may be wider than an ON-pulse portion of the image display scan pulse. The sensing scan pulse may include one ON-pulse portion or a plurality of ON-pulse portions within sensing ON-time of one line. In aspects disclosed herein, the sensing ON-time of one line is time required to simultaneously sense subpixels of one line and is hereinafter referred to as "1-line sensing ON-time".

The timing controller 11 generates timing control signals for controlling operation timings of the data driver circuit 12, the scan driver circuit 13, and a sensing circuit based on timing signals Vsync, Hsync, MCLK and DE synchronized with signals of an input image. The timing controller 11 distinguishes the driving mode from the sensing mode and controls the data driver circuit 12, the scan driver circuit 13, and the sensing circuit in conformity with each of the driving mode and the sensing mode.

In the sensing mode, the timing controller 11 may transmit digital data corresponding to a sensing data voltage to the data driver circuit 12. In the sensing mode, the timing controller 11 applies sensing data SD transmitted from the data driver circuit 12 to a previously set compensation algorithm to derive a threshold voltage variation ΔVth and a mobility variation ΔK, and then stores compensation data capable of compensating for the variations in a memory 16. In the driving mode, the timing controller 11 modulates digital video data RGB of the input image using the compensation data stored in the memory 16 and then transmits the modulated digital video data RGB to the data driver circuit 12.

Figure 29:
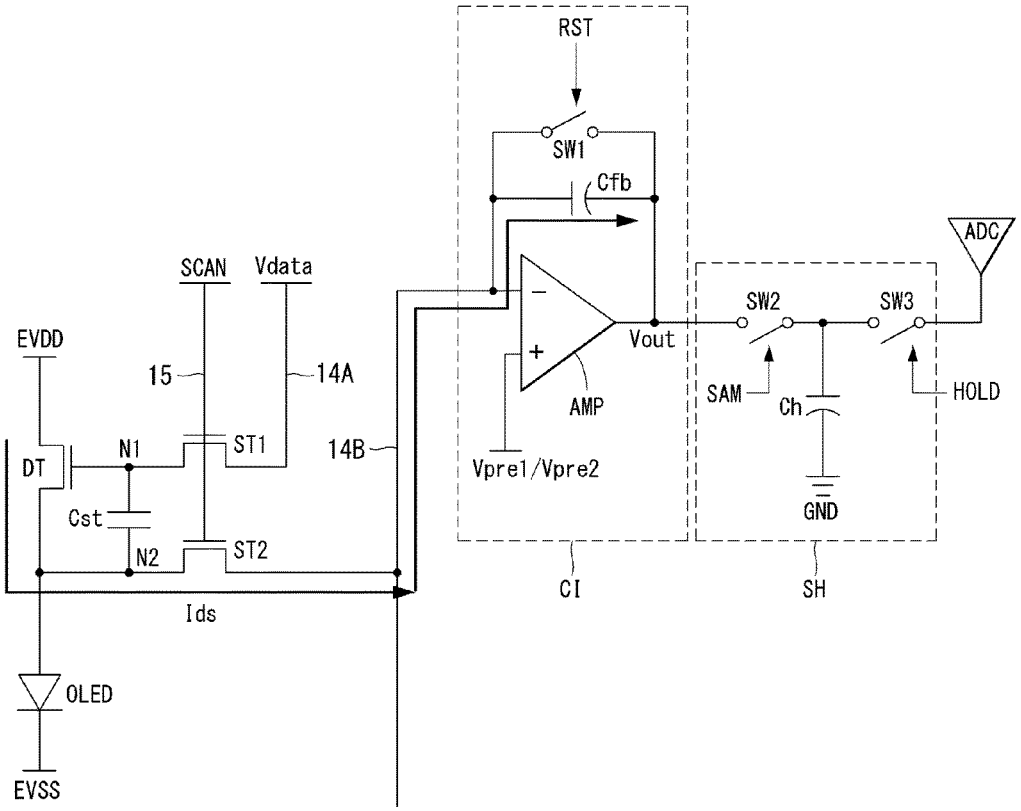
FIGS. 29 and 30 illustrate a connection structure of a subpixel and a sensing unit and a sensing principle.
Figure 30:
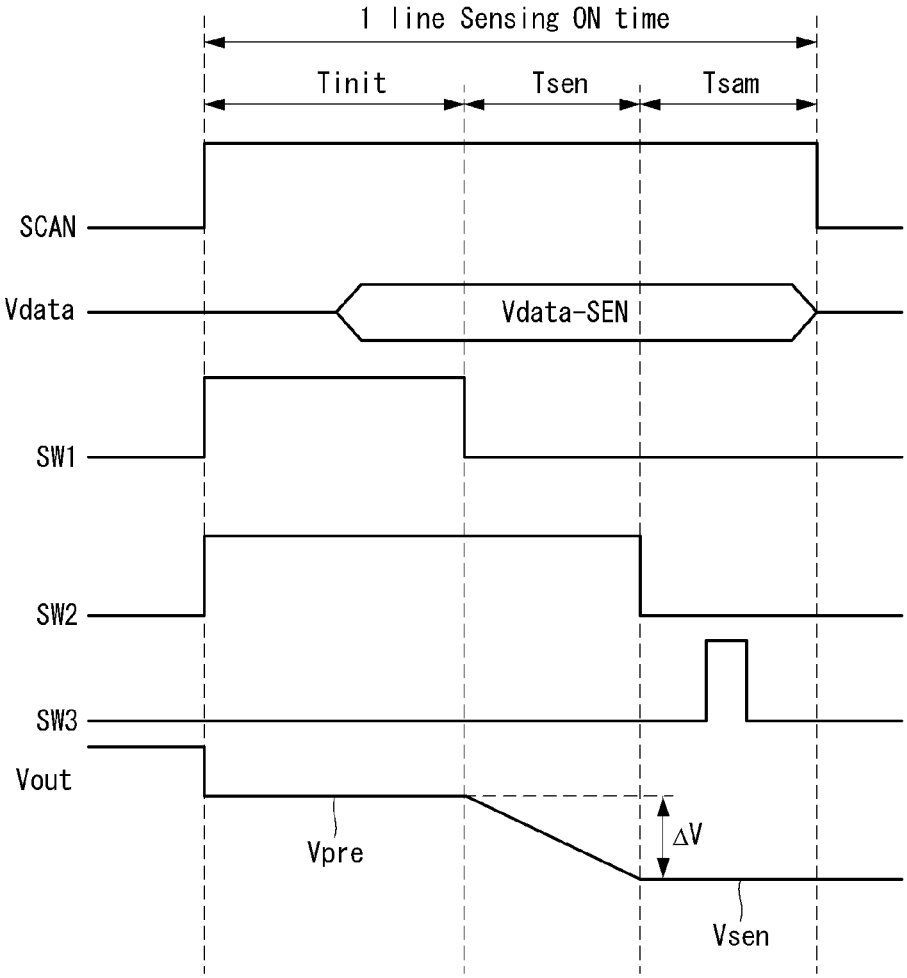

FIG. 29 illustrates a connection structure of a subpixel and a sensing unit. FIG. 30 illustrates one sensing waveform of each subpixel within 1-line sensing ON-time defined as an ON-pulse portion of a sensing scan pulse SCAN.

Referring to FIG. 29, a subpixel P includes an OLED, a driving TFT DT, a storage capacitor Cst, a first switching TFT ST1, a second switching TFT ST2, and the like.

The current integrator CI of the sensing unit includes an operational amplifier AMP having an inverting input terminal (−) that is connected to the sensing line 14B and receives a source-to-drain current Ids of the driving TFT DT from the sensing line 14B, an non-inverting input terminal (+) receiving a reference voltage Vpre, and an output terminal for outputting an integrated value Vsen (Vout); an integration capacitor Cfb connected between the inverting input terminal (−) and the output terminal of the operational amplifier AMP; and a first switch SW1 connected to both terminals of the integration capacitor Cfb.

The sampling circuit SH of the sensing unit includes a second switch SW2 that is switched on and off in response to a sampling signal SAM, a third switch SW3 that is switched on and off in response to a holding signal HOLD, and a holding capacitor Ch of which one terminal is connected between the second switch SW2 and the third switch SW3 and the other terminal is connected to a ground voltage source GND.

Referring to FIG. 30, the sensing mode is performed through an initialization period Tinit, a sensing period Tsen, and a sampling period Tsam.

In the initialization period Tinit, the operational amplifier AMP operates as a unit gain buffer with a gain of 1 due to the turn-on of the first switch SW1. In the initialization period Tinit, the input terminals (+, −) and the output terminal of the operational amplifier AMP, the sensing line 14B, and a second node N2 are all initialized to the reference voltage Vpre.

During the initialization period Tinit, a sensing data voltage Vdata-SEN is applied to a first node N1 through the DAC of the data driver circuit 12. Hence, a source-to-drain current Ids corresponding to a voltage difference {(Vdata-SEN)−Vpre} between the first node N1 and the second node N2 flows in the driving TFT DT, and the driving TFT DT is stabilized. Because the operational amplifier AMP continues to operate as the unit gain buffer during the initialization period Tinit, a voltage of the output terminal of the operational amplifier AMP is held at the reference voltage Vpre.

In the sensing period Tsen, the operational amplifier AMP operates as the current integrator CI due to the turn-off of the first switch SW1 and integrates the source-to-drain current Ids flowing in the driving TFT DT. In the sensing period Tsen, a voltage difference between both terminals of the integration capacitor Cfb increases due the source-to-drain current Ids entering the inverting input terminal (−) of the operational amplifier AMP as a sensing time has passed, i.e., an amount of the accumulated current Ids increases.

The inverting input terminal (−) and the non-inverting input terminal (+) of the operational amplifier AMP are short-circuited through a virtual ground due to the properties of the operational amplifier AMP, and a voltage difference between the inverting input terminal (−) and the non-inverting input terminal (+) is zero. Therefore, in the sensing period Tsen, the voltage of the inverting input terminal (−) is held at the reference voltage Vpre regardless of an increase in the voltage difference of the integration capacitor Cfb. In this instance, a voltage of the output terminal of the operational amplifier AMP is reduced in accordance with the voltage difference between both terminals of the integration capacitor Cfb. Based on such a principle, the current Ids entering through the sensing line 14B in the sensing period Tsen is generated as the integrated value Vsen, which is a voltage value, through the integration capacitor Cfb. A falling slope of an output Vout of the current integrator CI increases as an amount of current Ids entering through the sensing line 14B increases. Therefore, a magnitude of the integrated value Vsen decreases as the amount of current Ids increases. In the sensing period Tsen, the integrated value Vsen is stored in the holding capacitor Ch via the second switch SW2.

In the sampling period Tsam, when the third switch SW3 is turned on, the integrated value Vsen stored in the holding capacitor Ch is input to the ADC via the third switch SW3. The integrated value Vsen is converted into digital data, as sensing data SD, by the ADC and then transmitted to the timing controller 11. The sensing data SD is used as basic data for determining the compensation for the threshold voltage variation ΔVth and the mobility variation ΔK of the driving TFT DT in the timing controller 11.

A memory of the timing controller 11 previously stores a capacitance of the integration capacitor Cfb, the reference voltage Vpre, and a value of the sensing period Tsen in digital code. Thus, the timing controller 11 can calculate the source-to-drain current Ids (=Cfb*ΔV/At, where ΔV=Vpre-Vsen, and Δt=Tsen) flowing in the driving TFT DT from the sensing data SD which is digital code for the integrated value Vsen.

The timing controller 11 applies the source-to-drain current Ids flowing in the driving TFT DT to a compensation algorithm to derive variations (including the threshold voltage variation ΔVth and the mobility variation ΔK) and compensation data (Vth+ΔVth and K+ΔK) for compensating for the variations. The compensation algorithm may be implemented as a lookup table or a calculation logic.

The integration capacitor Cfb of the current integrator CI has a small capacitance corresponding to one-several hundredths of a parasitic capacitance of the sensing line 14B. Thus, a current sensing method according to the aspect can drastically reduce time required to receive an amount of current Ids up to a current value that can be sensed, as compared to a related art voltage sensing method. Moreover, it takes a long time for the voltage sensing method to sense a threshold voltage of the driving TFT because a source voltage of the driving TFT is sampled as a sensing voltage after the source voltage is saturated. On the other hand, the current sensing method according to the aspect of the disclosure can greatly reduce time required to sense a threshold voltage and mobility of the driving TFT because an integration of the source-to-drain current of the driving TFT and the sampling of an integrated value can be performed within a short time through the current sensing.

The integration capacitor Cfb of the current integrator CI can obtain an accurate sensing value because values stored in the integration capacitor Cfb are not changed depending on a load of the display panel 10 and are easily calibrated, unlike the parasitic capacitance of the sensing line 14B.

The current sensing method according to the aspect has advantages of low current sensing and high-speed sensing over the related art voltage sensing method. Because the current sensing method according to the aspect can perform the low current sensing and the high-speed sensing, the current sensing method according to the aspect can sense each subpixel multiple times within 1-line sensing ON-time in order to improve a sensing performance.

Figure 31:
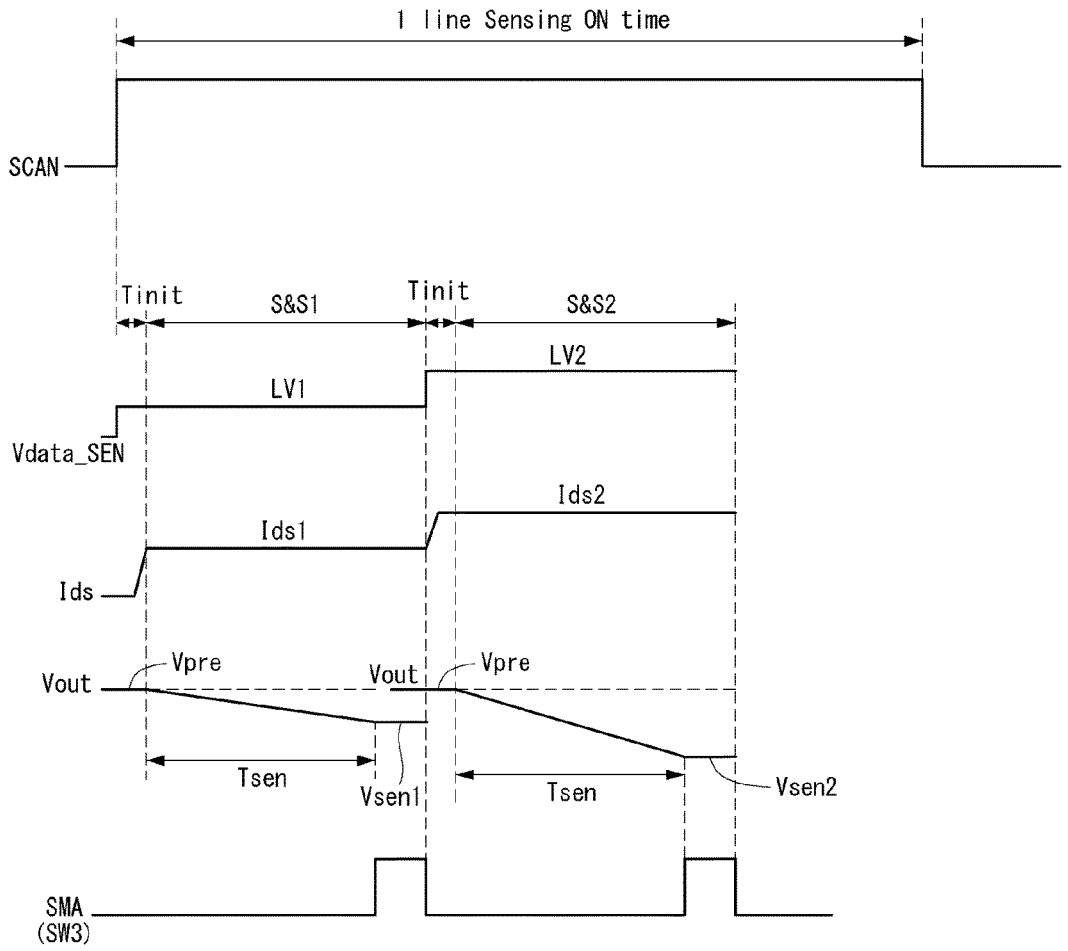
FIGS. 31 to 33 illustrate a multi-time current sensing method according to an aspect of the disclosure.
Figure 32:
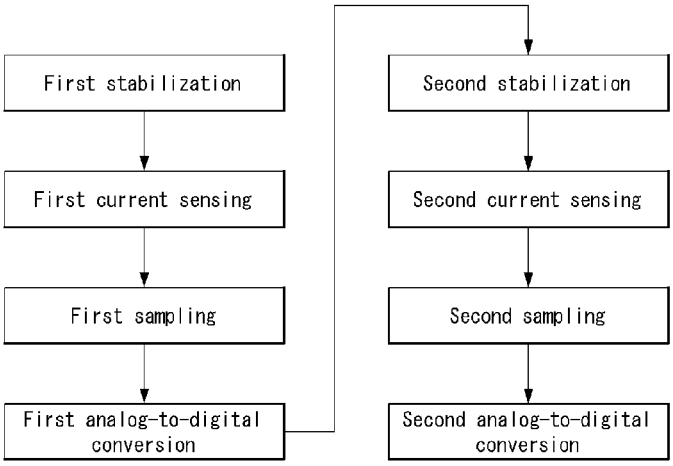
Figure 33:
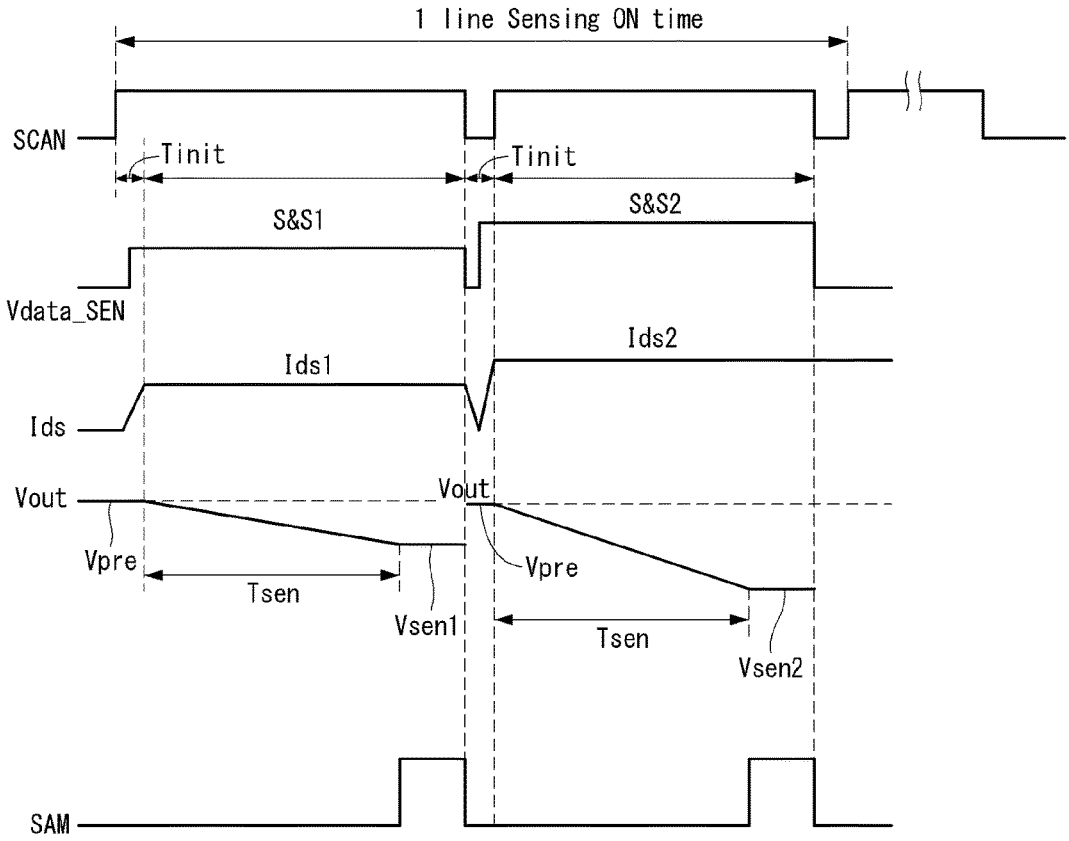

FIGS. 31 to 33 illustrate a multi-time current sensing method according to an aspect. More specifically, FIGS. 31 to 33 illustrate that the multi-time current sensing method is configured to perform a current sensing operation twice, by way of example. However, aspects are not limited thereto. For example, the multi-time current sensing method according to the aspect of the disclosure may be configured to perform the current sensing operation on each subpixel two or more times.

Referring to FIGS. 31 and 32, a sensing and sampling operation may be performed on the same subpixel twice within 1-line sensing ON-time. The 1-line sensing ON-time includes a first sensing and sampling period S&S1 for performing an integration of a first source-to-drain current Ids1 with a sensing data voltage Vdata-SEN of a first level LV1 and a second sensing and sampling period S&S2 for performing an integration of a second source-to-drain current Ids2 with a sensing data voltage Vdata-SEN of a second level LV2. The initialization period Tinit may be allocated prior to each of the first and second sensing and sampling periods S&S1 and S&S2.

The sensing data voltages Vdata-SEN of the first level LV1 and the second level LV2 may be set to the same voltage. The first level LV1 may have a magnitude corresponding to a predetermined region of a low gray level current Ids1 in an entire grayscale range, and the second level LV2 may have a magnitude corresponding to a predetermined region of a high gray level current Ids2 in the entire grayscale range, or vice versa. Namely, the first level LV1 may be a voltage level corresponding to one of a predetermined region of the low gray level current Ids1 and a predetermined region of the high gray level current Ids2 in the entire grayscale range, and the second level LV2 may be a voltage level corresponding to the other.

In a first initialization period Tinit, the same operations as in the initialization period Tinit of FIG. 25, namely, an initialization operation and a source-to-drain current stabilization operation are first performed.

In the first sensing and sampling period S&S1, the same operation as in the sensing period Tsen and the sampling period Tsam are performed. More specifically, the first source-to-drain current Ids1 is sensed and firstly integrated; a first integrated value Vsen1 is sampled and firstly analog-to-digital converted; and then a first digital sensed value is stored in an internal latch.

In the second initialization period Tinit, the same operations as in the initialization period Tinit of FIG. 25, namely, an initialization operation and a source-to-drain current stabilization operation are secondly performed.

In the second sensing and sampling period S&S2, the same operations as in the sensing period Tsen and sampling period Tsam are performed. More specifically, the second source-to-drain current Ids2 is sensed and secondly integrated; a second integrated value Vsen1 is sampled and secondly analog-to-digital converted; and then a second digital sensed value is stored in the internal latch.

The sensing periods Tsen respectively included in the first and second sensing and sampling periods S&S1 and S&S2 are equal in length.

The timing controller 11 calculates the first and second source-to-drain currents Ids1 and Ids2 based on the first and second digital sensed values and may derive desired variations ΔVth and ΔK using a calculation logic or a lookup table.

The timing controller 11 may apply the calculated first and second source-to-drain currents Ids1 and Ids2 to an OLED current equation ($Ids=K(Vgs-Vth)^2$) to obtain two current equations ($Ids1=K(Vgs1-Vth)^2$) and ($Ids2=K(Vgs2-Vth)^2$). The timing controller 11 may calculate a threshold voltage Vth of a corresponding subpixel using the two current equations and then calculate a mobility K by putting the calculated threshold voltage Vth to one of the OLED current equations. The timing controller 11 may compare the calculated threshold voltage Vth and mobility K with previously stored reference values to derive desired variations ΔVth and ΔK.

The timing controller 11 may calculate first and second current variations by comparing the calculated threshold voltage Vth and mobility K with the previously stored reference values, and derive a threshold voltage variation ΔVth and a mobility variation ΔK using the first and second current variations as read addresses.

It is known that the source-to-drain current of the driving TFT is greatly affected by change in the threshold voltage in a low gray level region and is greatly affected by change in the mobility in a high gray level region. Thus, as shown in FIG. 33, the timing controller 11 can derive the threshold voltage variation ΔVth based on the first source-to-drain current Idsd1, which is less than the second source-to-drain current Ids2, using the lookup table. Further, the timing controller 11 can derive the mobility variation ΔK based on the second source-to-drain current Ids2, which is greater than the first source-to-drain current Idsd1, using the lookup table.

In order to apply the same stabilization condition to the first and second sensing and sampling periods S&S1 and S&S2, as shown in FIG. 33, the timing controller 11 may control the operation of the scan driver circuit 13 to generate the sensing scan pulse SCAN in multiple pulses so that two or more ON-pulse portions of the sensing scan pulse SCAN are included in 1-line sensing ON-time. The stabilization condition may include gate delay, data charging delay, etc.

Figure 34:
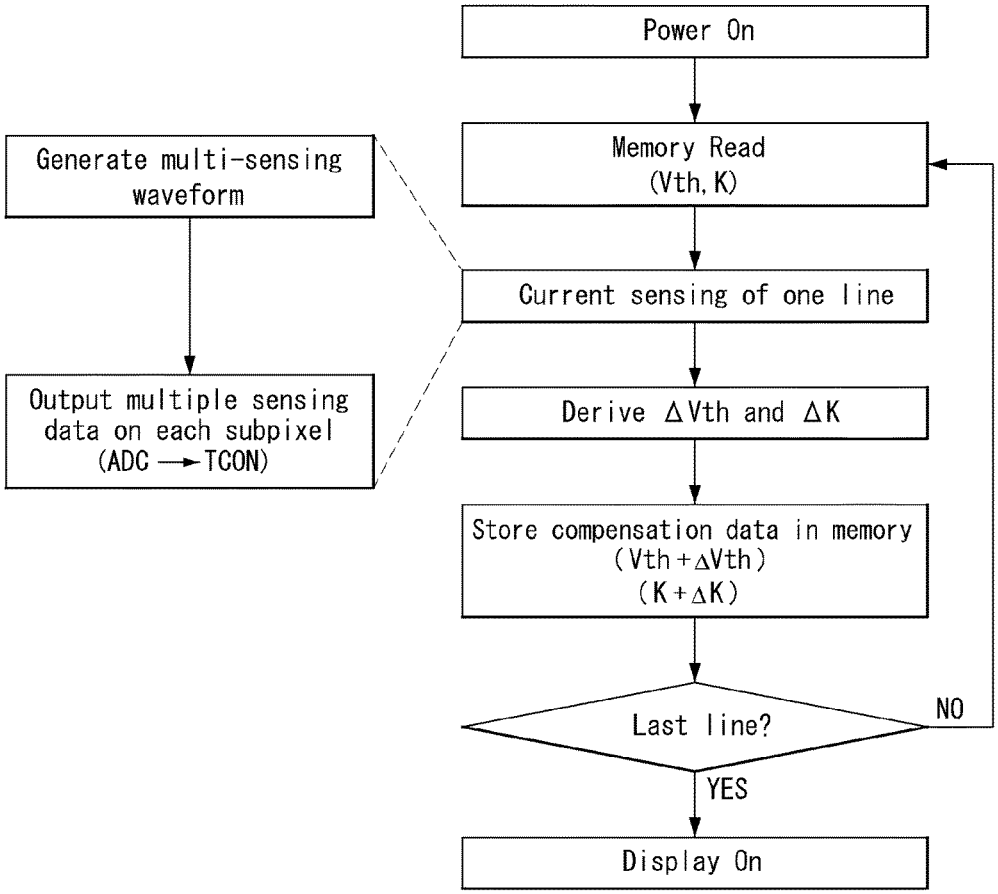
FIG. 34 is a flow chart illustrating a method of compensating for change in driving characteristics of a pixel during a power-on sequence.
Figure 35:
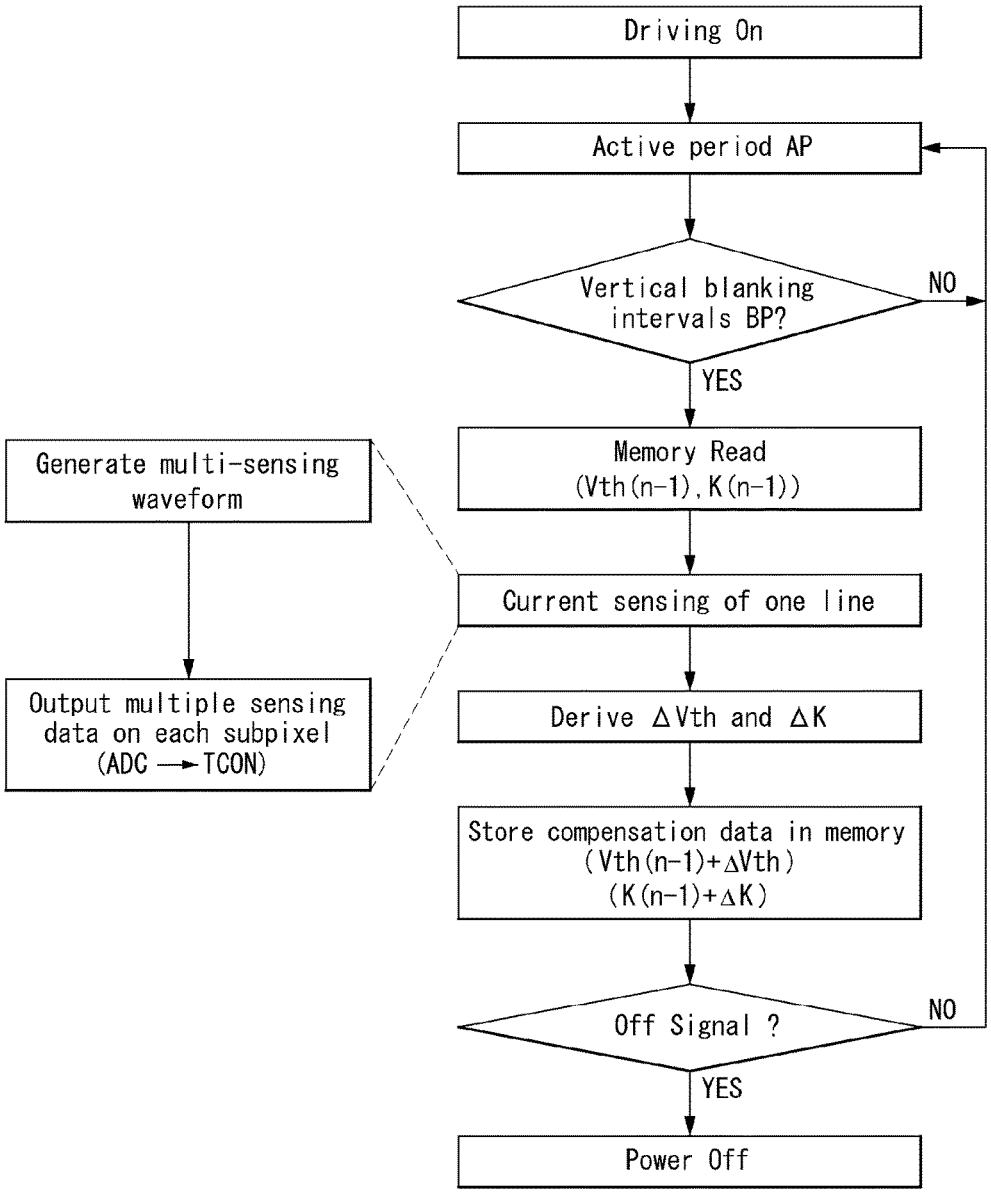
FIG. 35 is a flow chart illustrating a method of compensating for change in driving characteristics of a pixel using real-time sensing.
Figure 36:
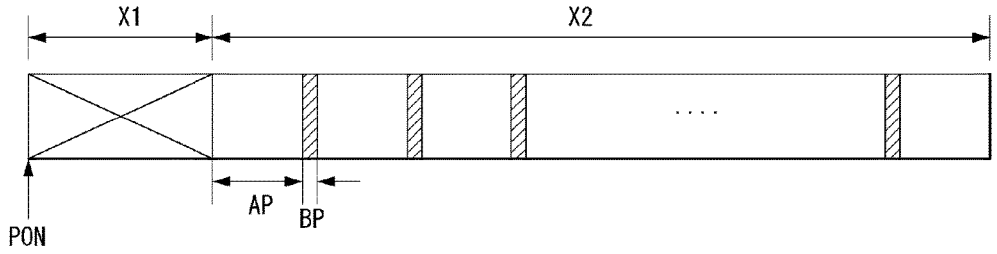
FIGS. 36 and 37 illustrate an initial non-display period, an active display period, and a vertical blanking interval in a power-on sequence.
Figure 37:
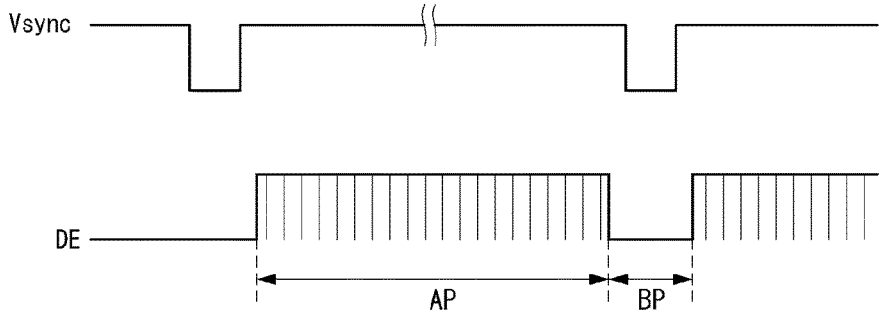

FIG. 34 is a flow chart illustrating a method of compensating for change in driving characteristics of a pixel during a power-on sequence. FIG. 35 is a flow chart illustrating a method of compensating for change in driving characteristics of a pixel using RT sensing. FIGS. 36 and 37 illustrate an initial non-display period, an active display period, and a vertical blanking interval in a power-on sequence.

A compensation method shown in FIG. 34 includes a sensing mode performed on all the subpixels during a predetermined initial non-display period X1 of a power-on sequence. A compensation method shown in FIG. 35 compensates for change in driving characteristics of the subpixels based on a result of real-time sensing the subpixels disposed on one line during a vertical blanking interval BP in a driving mode.

As shown in FIG. 36, the initial non-display period X1 may be defined as a non-display period that lasts for several tens to several hundreds of frames from an application time of a driving power enable signal PON. As shown in FIGS. 36 and 37, the vertical blanking interval BP may be defined as a non-display period between active display periods AP during which an image is displayed. The data enable signal DE is not generated in the initial non-display period X1 and the vertical blanking intervals BP, and thus the image display data voltage is not supplied to the subpixel in the vertical blanking interval BP.

Referring to FIG. 34, the aspect reads a previous threshold voltage Vth and a previous mobility K of the subpixels from a memory during the power-on sequence. Subsequently, the aspect applies the above-described multi-time current sensing method to a selected line to obtain sensing data SD from each subpixel. Subsequently, the aspect respectively compares a current threshold voltage Vth and a current mobility K obtained from the sensing data SD of each subpixel with the previous threshold voltage Vth and the previous mobility K read from the memory to calculate a threshold voltage variation ΔVth and a mobility variation ΔK. The aspect then stores compensation data (Vth+ΔVth and K+ΔK) capable of compensating for the variations ΔVth and ΔK in the memory.

Referring to FIG. 35, the aspect reads a previous threshold voltage Vth(n−1) and a previous mobility K(n−1) of the subpixels, that are stored in a previous compensation operation, from a memory in the vertical blanking interval BP. Subsequently, the aspect applies the multi-time current sensing method to each of subpixels of a selected line to obtain a plurality of sensing data SD. Subsequently, the aspect respectively compares a current threshold voltage Vth and a current mobility K obtained from the sensing data SD with the previous threshold voltage Vth(n−1) and the previous mobility K(n−1) read from the memory to calculate a threshold voltage variation ΔVth and a mobility variation ΔK. The aspect then stores compensation data (Vth+ΔVth and K+ΔK) capable of compensating for the variations ΔVth and ΔK in the memory.

Figure 38:
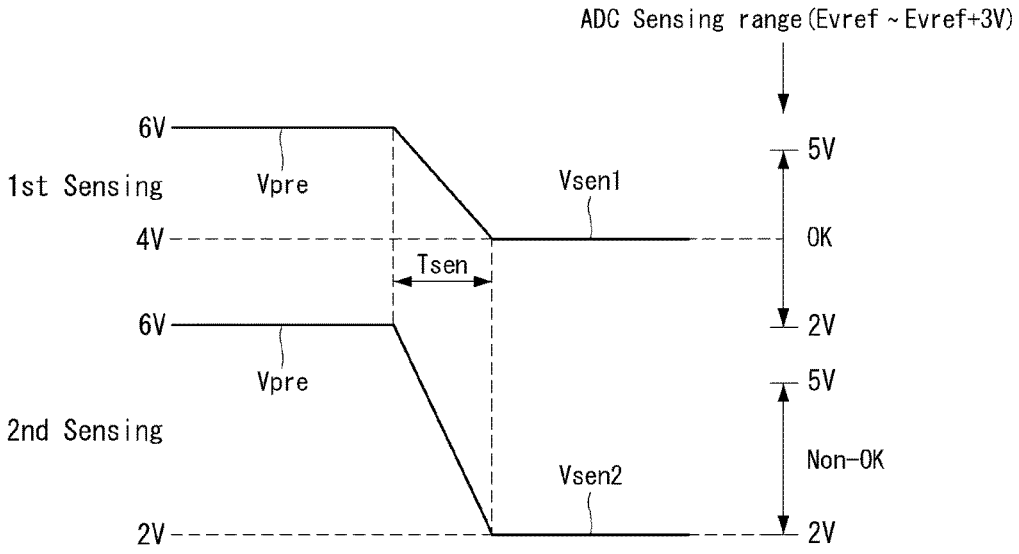
FIG. 38 illustrates an over-range situation of an analog-to digital converter (ADC) that may occur in a multi-time current sensing method according to an aspect of the disclosure.

FIG. 38 illustrates an over-range situation of an ADC that may occur in a multi-time current sensing method according to an aspect.

An ADC is a special encoder that converts an analog signal into data of a digital signal type. The ADC has a fixed input voltage range, i.e., fixed sensing range. A voltage range of the ADC may vary depending on a resolution of analog-to-digital conversion, but may be generally set to "Evref" to "Evref+3V", where Evref is a reference voltage of the ADC. In aspects disclosed herein, the resolution of analog-to-digital conversion indicates bit rate that is used to convert an analog input voltage into a digital value. When an analog signal input to the ADC is beyond the input voltage range of the ADC, an output value of the ADC may be underflowed to a lower limit of the input voltage range or overflowed to an upper limit of the input voltage range.

The aspect generates different analog integrated values Vsen by performing the sensing operation on each subpixel at least twice in accordance with the multi-time current sensing method. When a large amount of current Ids enters the current integrator CI, an output magnitude of the integrated value Vsen decreases. On the contrary, when a small amount of current Ids enters the current integrator CI, an output magnitude of the integrated value Vsen increases. Thus, some of the integrated values Vsen having various magnitudes may be beyond the input voltage range of the ADC.

In an example of FIG. 38, when the input voltage range of the ADC is 2V to 5V, a first integrated value Vsen1 corresponding to a first current Ids1 is 4V, and a second integrated value Vsen2 corresponding to a second current Ids2 greater than the first current Ids1 is 1.5V.

Referring to FIG. 38, because the first integrated value Vsen1 of 4V is within the input voltage range (2V to 5V) of the ADC, the first integrated value Vsen1 can be normally output. On the other hand, because the second integrated value Vsen2 of 1.5V is out of the input voltage range (2V to 5V) of the ADC, the second integrated value Vsen2 may be underflowed and output to a lower limit "2V" of the input voltage range close to 1.5V.

When an over-range phenomenon of the ADC occurs as described above, accuracy of sensing is reduced. Thus, there is a need for an additional solution to prevent the over-range phenomenon of the ADC.

Figure 39:
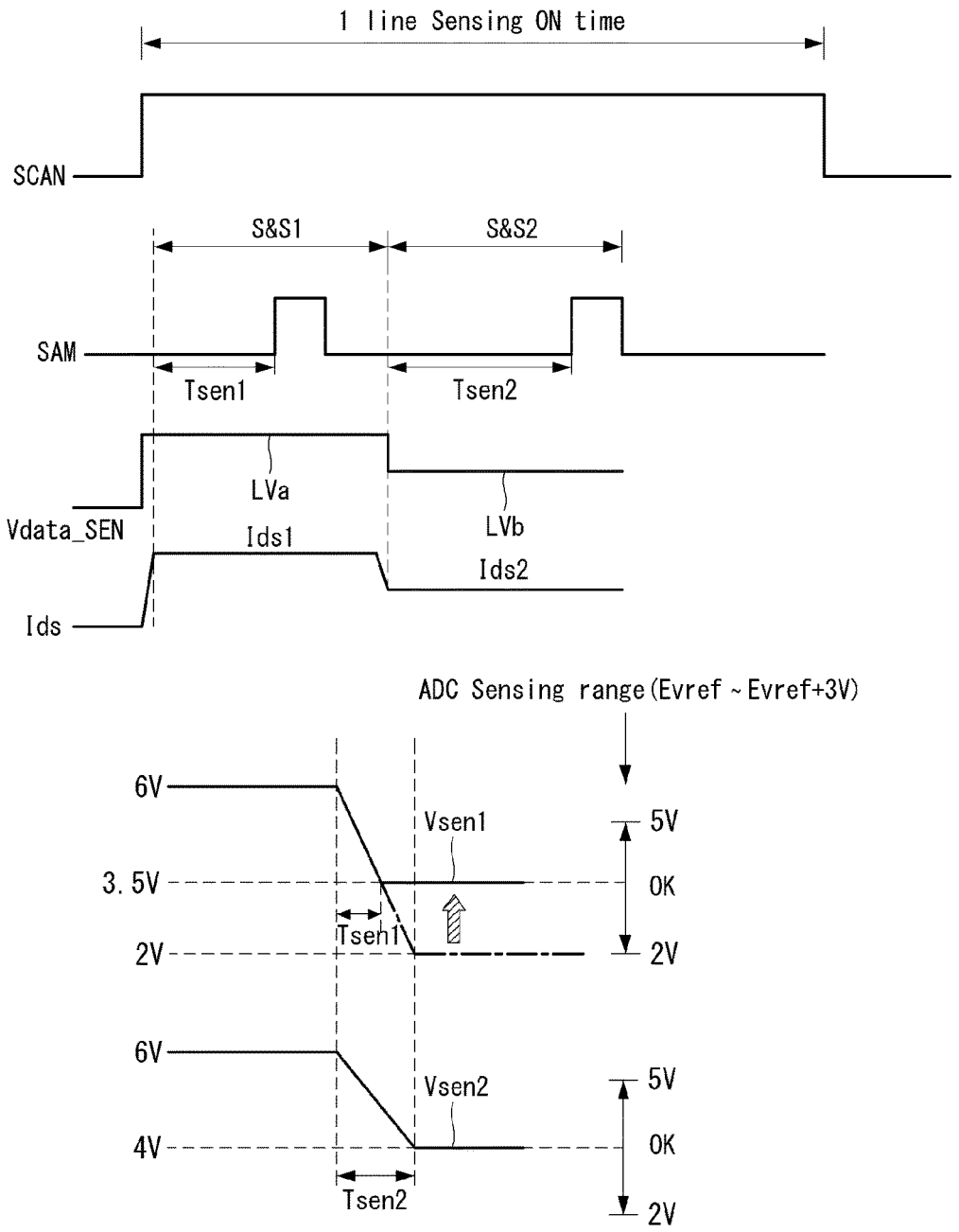
FIG. 39 illustrates an aspect of the disclosure capable of preventing an over-range phenomenon of an ADC.

FIG. 39 illustrates one aspect capable of preventing an over-range phenomenon of an ADC.

Referring to FIG. 39, the integrated value is more likely to be underflowed in the first sensing and sampling period S&S1, in which a falling slope of an output Vout of the current integrator CI is relatively larger, than in the second sensing and sampling period S&S2, in which a falling slope of the output Vout of the current integrator CI is relatively smaller.

Thus, the aspect can increase the first integrated value Vsen1 from 2V to 3.5V by making the sensing period Tsen1 of the first sensing and sampling period S&S1 shorter than the sensing period Tsen2 of the second sensing and sampling period S&S2, thereby correcting the first integrated value Vsen1 so that it satisfies the input voltage range (2V to 5V) of the ADC.

Figure 40:
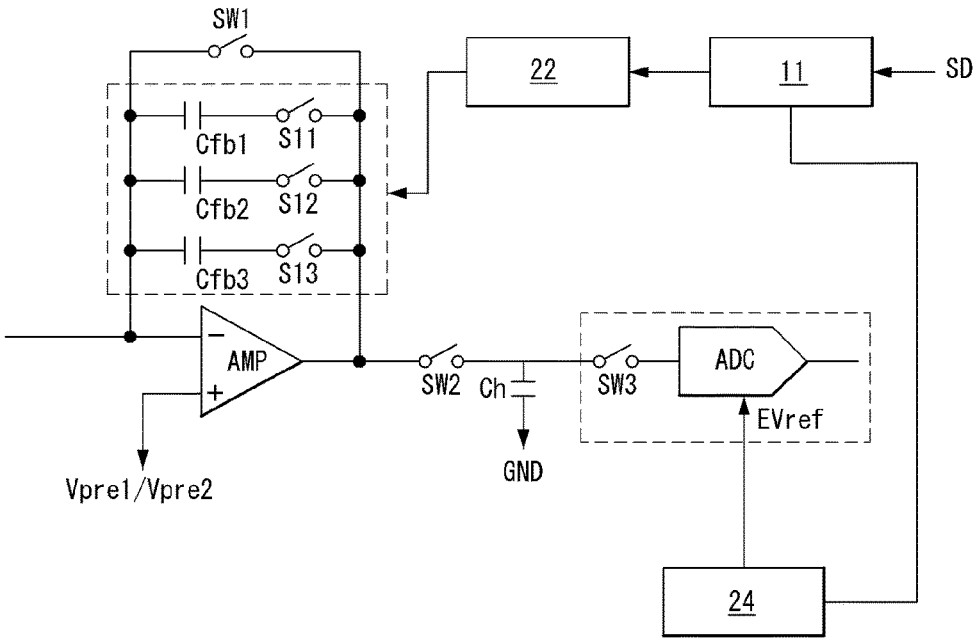
FIGS. 40 to 42 illustrate other aspects capable of preventing an over-range phenomenon of an ADC.
Figure 41:
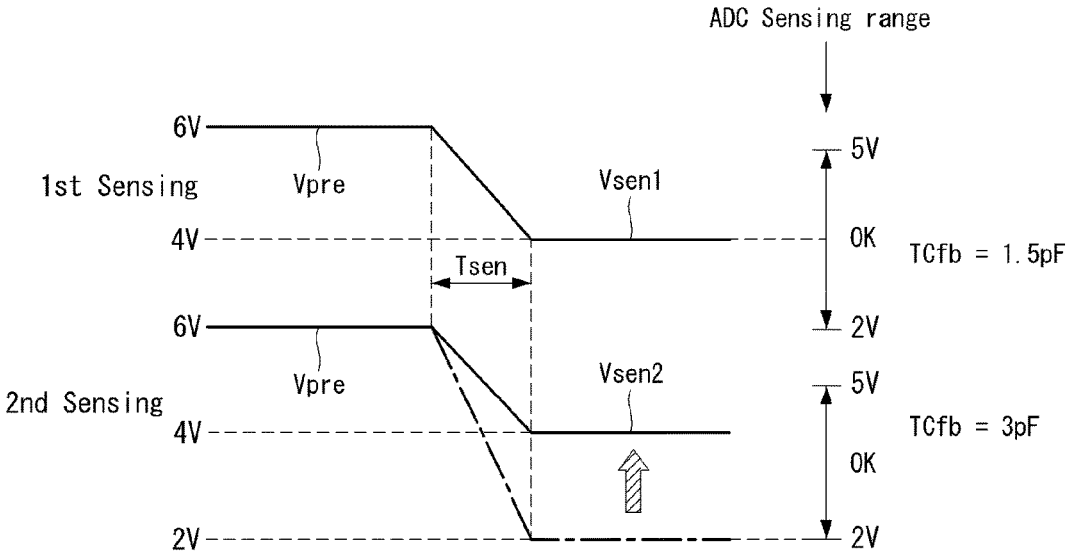
Figure 42:
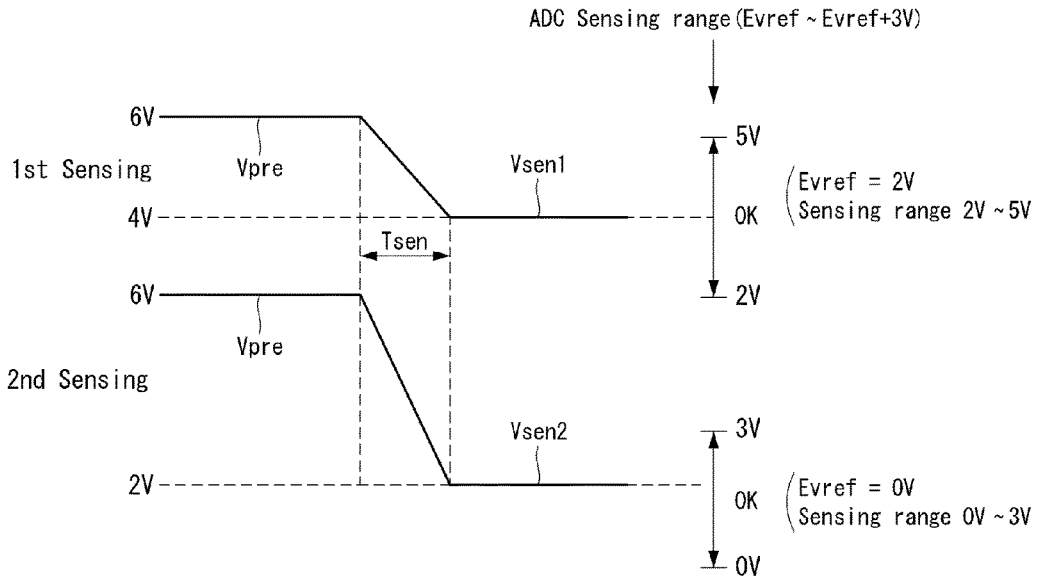

FIGS. 40 to 42 illustrate other aspects capable of preventing an over-range phenomenon of an ADC.

Referring to FIG. 40, the display device according to an aspect of the disclosure may further include a capacitance controller 22 for adjusting a capacitance of the integration capacitor Cfb included in the current integrator CI under the control of the timing controller 11. The integration capacitor Cfb includes a plurality of capacitors Cfbl, Cfb2, and Cfb3 connected in parallel to the inverting input terminal (−) of the operational amplifier AMP. The other terminals of the capacitors Cfb1, Cfb2, and Cfb3 may be connected to the output terminal of the operational amplifier AMP through different capacitance control switches S11, S12, and S13. A coupling capacitance of the integration capacitor Cfb is determined depending on the number of turned-on capacitance control switches S11, S12, and S13.

The timing controller 11 analyzes digital sensed values SD, controls an operation of the capacitance controller 22 based on a rate of digital sensed values SD that are equal to the lower limit and the upper limit of the ADC among the digital sensed values SD, and generates a proper switching control signal. The capacitance control switches S11, S12, and S13 are turned on and off in response to the switching control signal input from the capacitance controller 22. As the coupling capacitance of the integration capacitor Cfb increases, the falling slope of the output Vout of the current integrator CI decreases. On the contrary, as the coupling capacitance of the integration capacitor Cfb decreases, the falling slope of the output Vout of the current integrator CI increases.

The timing controller 11 controls the number of capacitance control switches S11, S12, and S13 turned on by the capacitance controller 22. Hence, when the output of the ADC is underflowed to the lower limit of the input voltage range of the ADC, the timing controller 11 can increase the coupling capacitance of the integration capacitor Cfb. On the contrary, when the output of the ADC is upflowed to the upper limit of the input voltage range of the ADC, the timing controller 11 can reduce the coupling capacitance of the integration capacitor Cfb.

FIG. 41 illustrates an over-range situation of the ADC is prevented by controlling the coupling capacitance of the integration capacitor Cfb. As shown in FIG. 41, the integrated value is more likely to be underflowed in the second sensing and sampling period S&S2, in which a falling slope of an output Vout of the current integrator CI is relatively larger, than in the first sensing and sampling period S&S1, in which a falling slope of the output Vout of the current integrator CI is relatively smaller.

Thus, the aspect can increase the second integrated value Vsen2 from 2V to 4V by increasing the coupling capacitance (i.e., 3 pF) of the integration capacitor Cfb operating during the second sensing and sampling period S&S2 to two times the coupling capacitance (i.e., 1.5 pF) of the integration capacitor Cfb operating during the first sensing and sampling period S&S1, thereby correcting the second integrated value Vsen2 so that it satisfies the input voltage range (2V to 5V) of the ADC.

Referring to FIG. 40, the display device according to an aspect may further include a programmable voltage control IC 24 for controlling an ADC reference voltage Evref under the control of the timing controller 11.

The timing controller 11 analyzes digital sensed values SD and controls an operation of the programmable voltage control IC 24 based on a rate of digital sensed values SD that are equal to the lower limit and the upper limit of the ADC among the digital sensed values SD, thereby controlling the ADC reference voltage Evref.

FIG. 42 illustrates an example of preventing an over-range situation of the ADC by controlling the ADC reference voltage Evref. In the multi-time current sensing method according to the aspect, as shown in FIG. 42, the second integrated value Vsen2 is more likely to be underflowed in the second sensing and sampling period S&S2, in which a falling slope of an output Vout of the current integrator CI is relatively larger, than in the first sensing and sampling period S&S1, in which a falling slope of the output Vout of the current integrator CI is relatively smaller.

Thus, the aspect holds the ADC reference voltage Evref used to digitize the first integrated value Vsen1 of 4V at an original voltage level of 2V and reduces the ADC reference voltage Evref used to digitize the second integrated value Vsen2 of 2V from the original voltage level of 2V to 0V. Hence, the second integrated value Vsen2 can sufficiently satisfy the input voltage range (0V to 3V) of the ADC through the voltage reduction.

As described above, the aspects of the present disclosure can improve the uniformity of image quality perceived by the viewer even in the display device, in which the initialization of the subpixels is non-uniform, by distributing spatially or temporally the first and second reference voltages to a value equal to or less than a visual resolution of human.

Although aspects have been described with reference to a number of illustrative aspects thereof, it should be understood that numerous other modifications and aspects can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device, comprising:

a display panel including data lines, first and second panel lines, scan lines, and pixels;

a power circuit configured to output first and second DC reference voltages initializing subpixels of the pixels;

a plurality of branch lines configured to divide a path of the first and second DC reference voltages into a plurality of paths; and a switch circuit configured to switch a path between the branch lines and the panel lines, wherein the switch circuit changes the path between the branch lines and the panel lines at a predetermined time interval, wherein each of the subpixels includes:

an organic light emitting diode (OLED), and a driving transistor configured to control a current flowing in an OLED depending on data of an input image, wherein the first and second DC reference voltages are respectively applied to first and second subpixels through the first and second panel lines at the predetermined time interval where the first and second subpixels are alternately arranged at least every one sub-pixel in at least one of a horizontal direction and a vertical direction of the display panel, and wherein a node between the driving transistor and the OLED in the first and second subpixels is respectively initialized to the first and second DC reference voltages at the predetermined time interval.

2. The display device of claim 1, wherein the predetermined time interval includes one or two horizontal periods.

3. The display device of claim 1, wherein the predetermined time interval includes each frame period.

4. The display device of claim 1, wherein the branch lines comprises a first line supplied with the first DC reference voltage and a second line supplied with the second DC reference voltage, the panel lines comprise first and second panel lines and the subpixels comprise first and second subpixels, wherein the switch circuit comprises:

a first switch between the first line and the first panel line;

a second switch between the second line and the first panel line;

a third switch between the first line and the second panel line; and a fourth switch between the second line and the second panel line.

5. The display device of claim 4, further comprising a buffer connected to each of the first line and the second line.

6. The display device of claim 4, wherein the first subpixels and the second subpixels are alternately arranged every one subpixel in each of a horizontal direction and a vertical direction of the display panel when the first DC reference voltage is supplied to the first subpixels and the second DC reference voltage is supplied to the second subpixels.

7. The display device of claim 4, wherein the first subpixels and the second subpixels are alternately arranged every one subpixel in a horizontal direction of the display panel and are alternately arranged every two subpixels in a vertical direction of the display panel when the first DC reference voltage is supplied to the first subpixels and the second DC reference voltage is supplied to the second subpixels.

8. The display device of claim 4, wherein the first subpixels and the second subpixels are alternately arranged every two subpixels in a horizontal direction of the display panel and are alternately arranged every one subpixel in a vertical direction of the display panel when the first DC reference voltage is supplied to the first subpixels and the second DC reference voltage is supplied to the second subpixels.

9. The display device of claim 4, wherein the first subpixels and the second subpixels are alternately arranged every one line of the display panel when the first DC reference voltage is supplied to the first subpixels and the second DC reference voltage is supplied to the second subpixels.

10. The display device of claim 4, wherein the first subpixels and the second subpixels are alternately arranged every one column of the display panel when the first DC reference voltage is supplied to the first subpixels and the second DC reference voltage is supplied to the second subpixels.

11. The display device of claim 4, wherein the first DC reference voltage is supplied to all of the subpixels of the display panel during a first frame period, and wherein the second DC reference voltage is supplied to all of the subpixels of the display panel during a second frame period.

12. A display device, comprising:

a display panel including data lines, first and second panel lines, scan lines, and pixels;

a first power circuit having a first line and configured to supply a first DC reference voltage to subpixels of the pixels through the first line;

a second power circuit having a second line and configured to supply a second DC reference voltage to the subpixels of the pixels through the second line;

a plurality of first branch lines configured to divide a first path of the first DC reference voltage into a plurality of paths;

a plurality of second branch lines configured to divide a second path of the second DC reference voltage into a plurality of paths;

a first switch circuit configured to switch a path between the plurality of first branch lines and the panel lines; and a second switch circuit configured to switch a path between the plurality of second branch lines and the panel lines, wherein each of the first and second switch circuits changes the path between the branch line and the panel lines at a predetermined time interval wherein each of the subpixels includes:

an organic light emitting diode (OLED), and a driving transistor configured to control a current flowing in an OLED depending on data of an input image, wherein the first and second DC reference voltages are respectively applied to first and second subpixels through the first and second panel lines at the predetermined time interval where the first and second subpixels are alternately arranged every one dot in at least one of a horizontal direction and a vertical direction, and wherein a node between the driving transistor and the OLED in the first and second subpixels is respectively initialized to the first and second DC reference voltages at the predetermined time interval.

13. The display device of claim 12, wherein the first switch circuit changes the first path between the plurality of first branch lines and the panel lines at a time interval of one or two horizontal periods, and wherein the second switch circuit changes the second path between the plurality of second branch lines and the panel lines at a time interval of one or two horizontal periods.

14. The display device of claim 12, wherein the first switch circuit changes the first path between the plurality of first branch lines and the panel lines in each frame period, and wherein the second switch circuit changes the second path between the plurality of second branch lines and the panel lines in each frame period.

15. The display device of claim 12, wherein the subpixels comprise first and second subpixels;

the first switch circuit comprises, a first switch connected between the first line and the first panel line, and a third switch connected between the first line and the second panel line, wherein the second switch circuit comprises, a second switch connected between the second line and the first panel line, and a fourth switch connected between the second line and the second panel line.

16. The display device of claim 15, wherein the first subpixels and the second subpixels are alternately arranged every one subpixel in each of a horizontal direction and a vertical direction of the display panel when the first DC reference voltage is supplied to the first subpixels and the second DC reference voltage is supplied to the second subpixels.

17. The display device of claim 15, wherein the first subpixels and the second subpixels are alternately arranged every one line or one column of the display panel when the first DC reference voltage is supplied to the first subpixels and the second DC reference voltage is supplied to the second subpixels.

18. The display device of claim 15, wherein the first and second DC reference voltages are supplied to all of the subpixels of the display panel during first and second frame periods, respectively.

19. The display device of claim 12, further comprising a buffer connected to each of the first line and the second line.

20. The display device of claim 12, wherein each of the panel lines is separated up and down inside a screen of the display panel.

* * * * *